US012064681B2

(12) United States Patent
Labonte et al.

(10) Patent No.: US 12,064,681 B2
(45) **Date of Patent: *Aug. 20, 2024**

(54) ICE SKATE BLADE

(71) Applicant: BAUER HOCKEY LLC, Exeter, NH (US)

(72) Inventors: Ivan Labonte, Montreal (CA); Alexis Seguin, Laval (CA); Jean-Francois Corbeil, Prevost (CA); Candide Deschenes, St-Jerome (CA)

(73) Assignee: BAUER HOCKEY LLC, Exeter, NH (US)

( * ) Notice: Subject to any disclaimer, the term of this patent is extended or adjusted under 35 U.S.C. 154(b) by 522 days.

This patent is subject to a terminal disclaimer.

(21) Appl. No.: 17/355,544

(22) Filed: Jun. 23, 2021

(65) Prior Publication Data

US 2021/0387075 A1 Dec. 16, 2021

Related U.S. Application Data

(63) Continuation of application No. 15/388,679, filed on Dec. 22, 2016, now Pat. No. 11,071,903.

(51) Int. Cl.

| | |
|---|---|
| ***A63C 1/32*** | (2006.01) |
| ***A63C 1/02*** | (2006.01) |
| ***A63C 1/30*** | (2006.01) |

(52) U.S. Cl.

CPC ..... *A63C 1/32* (2013.01); *A63C 1/02* (2013.01); *A63C 1/303* (2013.01)

(58) Field of Classification Search

CPC ..... A63C 1/32; A63C 1/02; A63C 1/303

See application file for complete search history.

(56) References Cited

U.S. PATENT DOCUMENTS

| | | | | |
|---|---|---|---|---|
| 1,115,790 | A | 11/1914 | Drevitson | |
| 1,319,094 | A | 10/1919 | Kerrigan | |
| 1,371,609 | A | 3/1921 | Drevitson | |
| 1,666,690 | A | 4/1928 | Drevitson | |
| 2,034,091 | A | 3/1936 | Dunbar | |
| 2,188,971 | A | 2/1940 | Adonizio | |
| 2,221,597 | A | 11/1940 | Malcolm | |
| 2,414,967 | A | 1/1947 | Clarence | |
| 2,520,548 | A | 8/1950 | Jack | |
| 2,687,955 | A | 8/1954 | Bloom | |
| 2,988,369 | A * | 6/1961 | Rebicek | A63C 1/30 280/11.18 |
| 3,212,786 | A | 10/1965 | Florjancic et al. | |
| 3,279,807 | A | 10/1966 | Jacobson | |
| 3,535,418 | A | 10/1970 | Daum et al. | |

(Continued)

OTHER PUBLICATIONS

Non-Final Office Action mailed on Nov. 2, 2017 in connection with U.S. Appl. No. 15/388,679, 21 pages.

(Continued)

*Primary Examiner* — Jacob B Meyer

(57) ABSTRACT

A blade for an ice skate (e.g., for playing hockey). The ice skate comprises a skate boot for receiving a foot of a user and a blade holder for holding the blade. The blade may be designed to be lightweight yet strong and possibly provide other performance benefits to the user, including by being made of different materials (e.g., at least three different materials) that are strategically arranged and secured to one another.

31 Claims, 20 Drawing Sheets

(56) References Cited

U.S. PATENT DOCUMENTS 3,558,149 A * 1/1971 Weidenbacker ..... A63C 1/30 280/11.12
3,785,662 A 1/1974 Staples
3,806,145 A 4/1974 Czeiszperger
3,866,927 A 2/1975 Tvengsberg
3,934,892 A 1/1976 Baikie
3,947,050 A 3/1976 Isely
3,954,278 A 5/1976 McLeod
3,967,832 A 7/1976 Chambers
4,053,168 A 10/1977 Goverde
4,071,938 A 2/1978 Chambers
4,074,909 A 2/1978 Baikie
4,085,944 A 4/1978 Chambers
4,088,335 A 5/1978 Norton et al.
4,093,249 A 6/1978 Chambers
4,108,450 A 8/1978 Cote
4,139,209 A 2/1979 Humphreys
4,150,837 A 4/1979 Zuuring
4,218,069 A 8/1980 Baikie
4,223,900 A 9/1980 Olivieri
4,251,086 A 2/1981 Woolley
4,264,090 A 4/1981 Davis
4,314,708 A 2/1982 Zuuring
4,336,948 A 6/1982 Couture
4,351,537 A 9/1982 Seidel
4,353,173 A 10/1982 Paquet
4,353,562 A 10/1982 Tiefenthal
4,384,413 A 5/1983 Bourque
4,385,456 A 5/1983 Livernois et al.
4,392,658 A 7/1983 Redmond et al.
4,453,727 A 6/1984 Bourque
4,492,385 A 1/1985 Olson
4,509,276 A 4/1985 Bourque
4,549,741 A 10/1985 Husak et al.
4,744,574 A 5/1988 Soo
4,773,658 A 9/1988 Bourque et al.
4,783,911 A 11/1988 Brown
4,826,183 A 5/1989 Bratland et al.
4,835,885 A 6/1989 Hoshizaki et al.
4,906,430 A 3/1990 Abkowitz et al.
4,907,813 A 3/1990 Hall
4,988,122 A 1/1991 Saunders
5,248,156 A * 9/1993 Cann ..... A63C 17/18 280/11.18
5,257,793 A 11/1993 Fortin
5,318,310 A 6/1994 Laberge
5,320,366 A 6/1994 Shing
5,332,242 A * 7/1994 Cann ..... A63C 1/303 280/11.18
5,360,227 A 11/1994 Lemelson
5,383,674 A * 1/1995 Cann ..... A63C 1/30 280/11.18
5,388,845 A 2/1995 Soo
5,411,278 A 5/1995 Wittmann
5,484,148 A 1/1996 Olivieri
5,498,033 A 3/1996 Hoshizaki et al.
5,641,169 A 6/1997 Bekessy
5,662,338 A 9/1997 Steinhauser, Jr.
5,769,434 A * 6/1998 Wurthner ..... A63C 17/20 280/11.18
5,829,170 A 11/1998 Lutz, Jr.
5,887,361 A 3/1999 Cabanis et al.
5,913,593 A 6/1999 Aird et al.
5,988,683 A * 11/1999 Venier ..... A63C 1/30 280/841
6,039,328 A * 3/2000 Pawlowski ..... A63C 17/18 280/11.18
6,079,128 A 6/2000 Hoshizaki et al.
6,105,975 A * 8/2000 Shum ..... A63C 1/32 280/11.12
6,109,622 A 8/2000 Reynolds
6,176,946 B1 1/2001 Kuehmann et al.
6,364,321 B1 4/2002 Steinhauser, Jr.
6,458,220 B1 10/2002 Kuehmann et al.
6,464,801 B2 10/2002 Kuehmann et al.
6,467,778 B1 10/2002 Goldsmith et al.
6,485,033 B2 * 11/2002 Nicoletti ..... A63C 1/303 280/11.18
6,499,233 B1 12/2002 Chenevert
6,761,363 B2 * 7/2004 Fask ..... A63C 1/32 280/11.18
7,219,900 B2 5/2007 Meibock
7,290,773 B2 11/2007 Eck
7,387,302 B2 * 6/2008 Goldsmith ..... A63C 1/32 280/11.18
7,398,609 B2 7/2008 Labonte
7,451,991 B2 11/2008 Labonte
7,533,479 B2 5/2009 Labonte
7,556,700 B2 7/2009 Boisvert
7,628,405 B2 * 12/2009 Smith, II ..... A63C 1/30 280/11.18
7,673,884 B2 * 3/2010 Wuerthner ..... A63C 1/32 280/610
7,762,681 B2 7/2010 Peckham, Jr.
7,793,947 B2 9/2010 Labonte
7,806,418 B2 * 10/2010 Labonte ..... A63C 1/22 280/11.18
7,866,673 B2 * 1/2011 Weber ..... A63C 1/30 280/11.12
7,866,675 B2 * 1/2011 Hauser ..... A63C 1/42 280/11.18
7,950,676 B2 5/2011 Goldsmith et al.
8,047,552 B2 11/2011 Julien
8,353,535 B2 * 1/2013 Salmon ..... A63C 1/28 280/7.14
8,454,030 B2 * 6/2013 Corbeil ..... A63C 1/303 280/11.18
8,534,680 B1 * 9/2013 Corbeil ..... A63C 1/303 280/11.18
RE44,805 E 3/2014 Dahlo
8,684,368 B2 4/2014 Van Horne et al.
8,770,595 B2 * 7/2014 Cruikshank ..... A63C 1/30 280/11.17
8,844,945 B2 * 9/2014 Koyess ..... A63C 1/32 280/11.18
8,857,823 B2 * 10/2014 Mars ..... A63C 1/28 280/11.15
9,295,901 B2 * 3/2016 Cruikshank ..... A63C 1/303
9,392,840 B2 7/2016 Champagne et al.
9,416,901 B2 * 8/2016 Weber ..... F16L 25/01
9,427,653 B1 * 8/2016 Chen ..... A63C 1/32
9,562,274 B2 2/2017 Garrison, Jr.
9,656,153 B2 5/2017 Van Horne
9,717,300 B2 8/2017 Van Horne et al.
10,195,514 B2 * 2/2019 Davis ..... A63C 1/303
10,532,269 B2 * 1/2020 Davis ..... A63C 1/32
10,974,123 B2 * 4/2021 Labonte ..... A63C 1/303
11,071,903 B2 * 7/2021 Labonte ..... A63C 1/303
2001/0003876 A1 6/2001 Racine
2001/0026054 A1 10/2001 Olson et al.
2002/0056972 A1 * 5/2002 Fask ..... A63C 1/32 280/607
2002/0093154 A1 7/2002 Durocher
2002/0098924 A1 7/2002 Houser et al.
2002/0190487 A1 12/2002 Blankenburg et al.
2003/0015848 A1 1/2003 Pham et al.
2003/0196351 A1 10/2003 Hipp et al.
2004/0016150 A1 1/2004 Labonte et al.
2004/0083625 A1 5/2004 Wilder
2004/0090023 A1 5/2004 Crowder
2004/0140631 A1 7/2004 Goldsmith et al.
2004/0168357 A1 9/2004 Meibock
2004/0200099 A1 10/2004 Chenevert
2005/0029755 A1 * 2/2005 Fask ..... A63C 1/32 280/11.18
2005/0116379 A1 6/2005 Goldsmith et al.
2005/0134010 A1 6/2005 Blankenburg et al.
2005/0193594 A1 9/2005 Murphy
2005/0229436 A1 10/2005 Bock
2006/0179686 A1 8/2006 Labonte
2006/0181035 A1 8/2006 Labonte
2006/0181076 A1 8/2006 Labonte

(56) References Cited

U.S. PATENT DOCUMENTS

| | | | | |
|---|---|---|---|---|
| 2008/0001369 | A1 | 1/2008 | Wylie et al. | |
| 2008/0150242 | A1* | 6/2008 | Wurthner | A63C 3/12 280/11.18 |
| 2008/0172906 | A1 | 7/2008 | Jou et al. | |
| 2009/0000151 | A1 | 1/2009 | Cavasin | |
| 2009/0020967 | A1 | 1/2009 | Weber et al. | |
| 2009/0243238 | A1 | 10/2009 | Van Horne et al. | |
| 2009/0273148 | A1* | 11/2009 | Wan | A63C 1/32 280/11.18 |
| 2009/0289427 | A1 | 11/2009 | Lovejoy | |
| 2010/0109312 | A1 | 5/2010 | Salmon et al. | |
| 2010/0176564 | A1* | 7/2010 | Koyess | A63C 1/32 280/11.18 |
| 2010/0192412 | A1 | 8/2010 | Stewart | |
| 2010/0194062 | A1* | 8/2010 | Hauser | A63C 1/32 280/11.18 |
| 2010/0201088 | A1 | 8/2010 | Newman et al. | |
| 2011/0001297 | A1* | 1/2011 | Labonte | A63C 1/32 280/11.12 |
| 2011/0016617 | A1 | 1/2011 | Shrewsburg | |
| 2011/0101665 | A1 | 5/2011 | Van Horne et al. | |
| 2011/0121527 | A1* | 5/2011 | Salmon | A63C 1/303 280/11.12 |
| 2011/0148054 | A1 | 6/2011 | Davis et al. | |
| 2011/0253268 | A1 | 10/2011 | Zou et al. | |
| 2012/0187642 | A1* | 7/2012 | Corbeil | A63C 1/303 280/11.18 |
| 2012/0204452 | A1 | 8/2012 | Van Horne et al. | |
| 2013/0038031 | A1* | 2/2013 | Cruikshank | A63C 1/42 280/11.18 |
| 2013/0228986 | A1* | 9/2013 | Corbeil | A63C 1/303 280/11.18 |
| 2014/0033575 | A1 | 2/2014 | Cruikshank | |
| 2014/0250733 | A1 | 9/2014 | Cruikshank et al. | |
| 2014/0259792 | A1 | 9/2014 | Van Horne | |
| 2014/0265175 | A1* | 9/2014 | Labonte | A63C 1/32 280/11.18 |
| 2014/0319790 | A1* | 10/2014 | Mayer | A63C 1/303 280/11.18 |
| 2016/0059107 | A1 | 3/2016 | Finley | |
| 2016/0193523 | A1* | 7/2016 | Gans | A63C 1/30 280/11.3 |
| 2016/0236065 | A1* | 8/2016 | Cruikshank | A63C 1/42 |
| 2018/0117448 | A1* | 5/2018 | Rouzier | A63C 1/02 |
| 2018/0178108 | A1* | 6/2018 | Labonte | A63C 1/02 |
| 2018/0185735 | A1* | 7/2018 | Labonte | A63C 1/02 |
| 2018/0361224 | A1* | 12/2018 | Labonte | A63C 1/303 |

OTHER PUBLICATIONS

Restriction Requirement mailed on Aug. 28, 2019 in connection with U.S. Appl. No. 15/388,679, 9 pages.
Final Office Action mailed on Mar. 30, 2018 in connection with U.S. Appl. No. 15/388,679, 26 pages.
Advisory Office Action mailed on Jun. 7, 2018 in connection with U.S. Appl. No. 15/388,679, 3 pages.
Non-Final Office Action mailed on Sep. 20, 2018 in connection with U.S. Appl. No. 15/388,679, 27 pages.
Restriction Requirement mailed on Aug. 29, 2019 in connection with U.S. Appl. No. 15/906,627, 10 pages.
Final Office Action mailed on Mar. 29, 2019 in connection with U.S. Appl. No. 15/388,679, 23 pages.
Restriction Requirement mailed on Apr. 12, 2019 in connection with U.S. Appl. No. 15/906,627, 8 pages.
Non-final Office Action issued on Feb. 3, 2020 in connection with U.S. Appl. No. 15/906,627, 44 pages.
Non-final Office Action issued on Feb. 7, 2020 in connection with U.S. Appl. No. 15/388,679, 21 pages.
Final Office Action issued on Jul. 28, 2020 in connection with U.S. Appl. No. 15/906,627, 8 pages.
Final Office Action issued on Sep. 10, 2020 in connection with U.S. Appl. No. 15/388,679, 23 pages.
Notice of Allowance issued on Dec. 10, 2020 in connection with U.S. Appl. No. 15/906,627, 5 pages.
Notice of Allowance issued on Mar. 24, 2021 in connection with U.S. Appl. No. 15/388,679, 9 pages.
Examiner Report issued on Oct. 26, 2022 in connection with Canadian Patent Application No. 2996761, 6 pages.
Examiner Report issued on Mar. 9, 2023 in connection with Canadian Patent Application No. 2,952,786, 5 pages.
Examiner Report issued on Jun. 19, 2023 in connection with Canadian Patent Application No. 2996761, 3 pages.

* cited by examiner

ICE SKATE BLADE

CROSS-REFERENCE TO RELATED APPLICATIONS

This application is a continuation of U.S. patent application Ser. No. 15/388,679, filed on Dec. 12, 2016, and issued as U.S. Pat. No. 11,071,903. The contents of the aforementioned application are incorporated by reference herein.

FIELD

The invention generally relates to ice skating and, more particularly, to ice skates and their blade.

BACKGROUND

An ice skate includes a skate boot for receiving a user's foot and a blade holder connecting a blade to the skate boot such that the blade engages ice while the user skates.

The blade has to be tough as it is subject to harsh conditions, including significant forces while the user skates and corrosive effects because it contacts the ice, yet should not be too heavy or bulky as this can affect skating performance. While many different types of blades have been developed, these conflicting considerations continue to pose challenges.

For these and/or other reasons, there is a need to improve ice skates, including their blades.

SUMMARY

In accordance with various aspects of the invention, there is provided a blade for an ice skate (e.g., for playing hockey). The ice skate comprises a skate boot for receiving a foot of a user and a blade holder for holding the blade. The blade may be designed to be lightweight yet strong and possibly provide other performance benefits to the user, including by being made of different materials (e.g., at least three different materials) that are strategically arranged and secured to one another.

For example, in accordance with an aspect of the invention, there is provided a blade for an ice skate. The ice skate comprises a skate boot for receiving a foot of a user and a blade holder for holding the blade. The blade comprises a polymeric upper member and a metallic ice-contacting lower member secured to the polymeric upper member. The metallic-ice contacting lower member comprises a metallic base comprising an ice-contacting surface and a metallic anchor affixed to the metallic base and the polymeric upper member.

In accordance with another aspect of the invention, there is provided a blade for an ice skate. The ice skate comprises a skate boot for receiving a foot of a user and a blade holder for holding the blade. The blade comprises a polymeric upper member and a metallic ice-contacting lower member secured to the polymeric upper member. The metallic ice-contacting lower member comprises a metallic base comprising an ice-contacting surface and a metallic anchor welded to the metallic base and bonded to the polymeric upper member.

In accordance with another aspect of the invention, there is provided a blade for an ice skate. The ice skate comprises a skate boot for receiving a foot of a user and a blade holder for holding the blade. The blade comprises an upper member and an ice-contacting lower member secured to the upper member. The ice-contacting lower member comprises a base comprising an ice-contacting surface and an anchor affixed to the base and the upper member. The upper member comprises a first material. The base comprises a second material different from the first material. The anchor comprises a third material different from the first material and the second material.

In accordance with another aspect of the invention, there is provided a blade for an ice skate. The ice skate comprises a skate boot for receiving a foot of a user and a blade holder for holding the blade. The blade comprises at least three materials that are different from one another.

These and other aspects of the invention will now become apparent to those of ordinary skill in the art upon review of the following description of embodiments of the invention in conjunction with the accompanying drawings.

BRIEF DESCRIPTION OF THE DRAWINGS

A detailed description of embodiments of the invention is provided below, by way of example only, with reference to the following drawings, in which.

Figure 1:
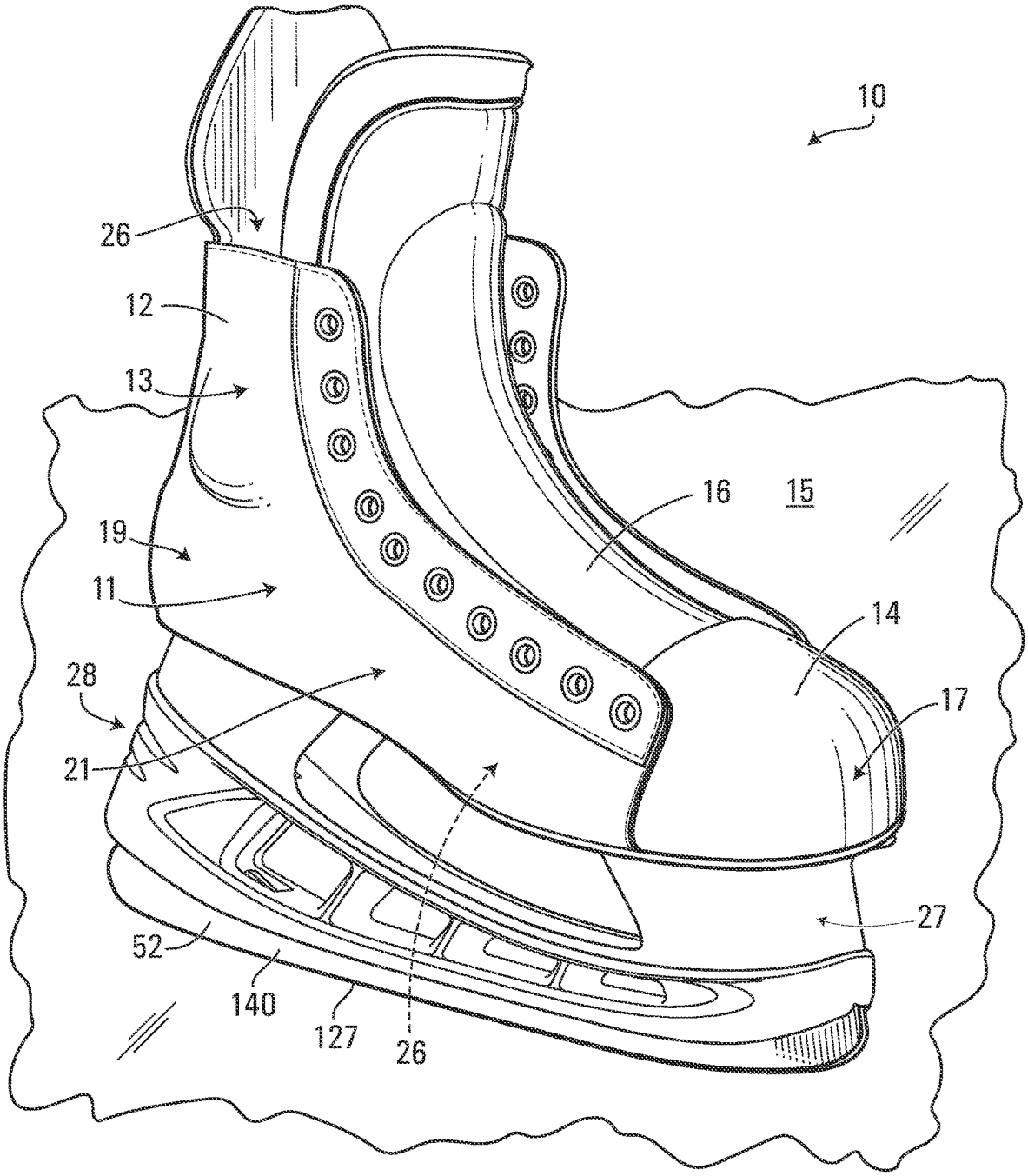
FIG. 1 is a perspective view of an example of an ice skate comprising a blade in accordance with an embodiment of the invention.

In the drawings, embodiments of the invention are illustrated by way of example. It is to be expressly understood that the description and drawings are only for purposes of illustration and as an aid to understanding, and are not intended to be a definition of the limits of the invention.

DETAILED DESCRIPTION OF EMBODIMENTS

Figure 2:
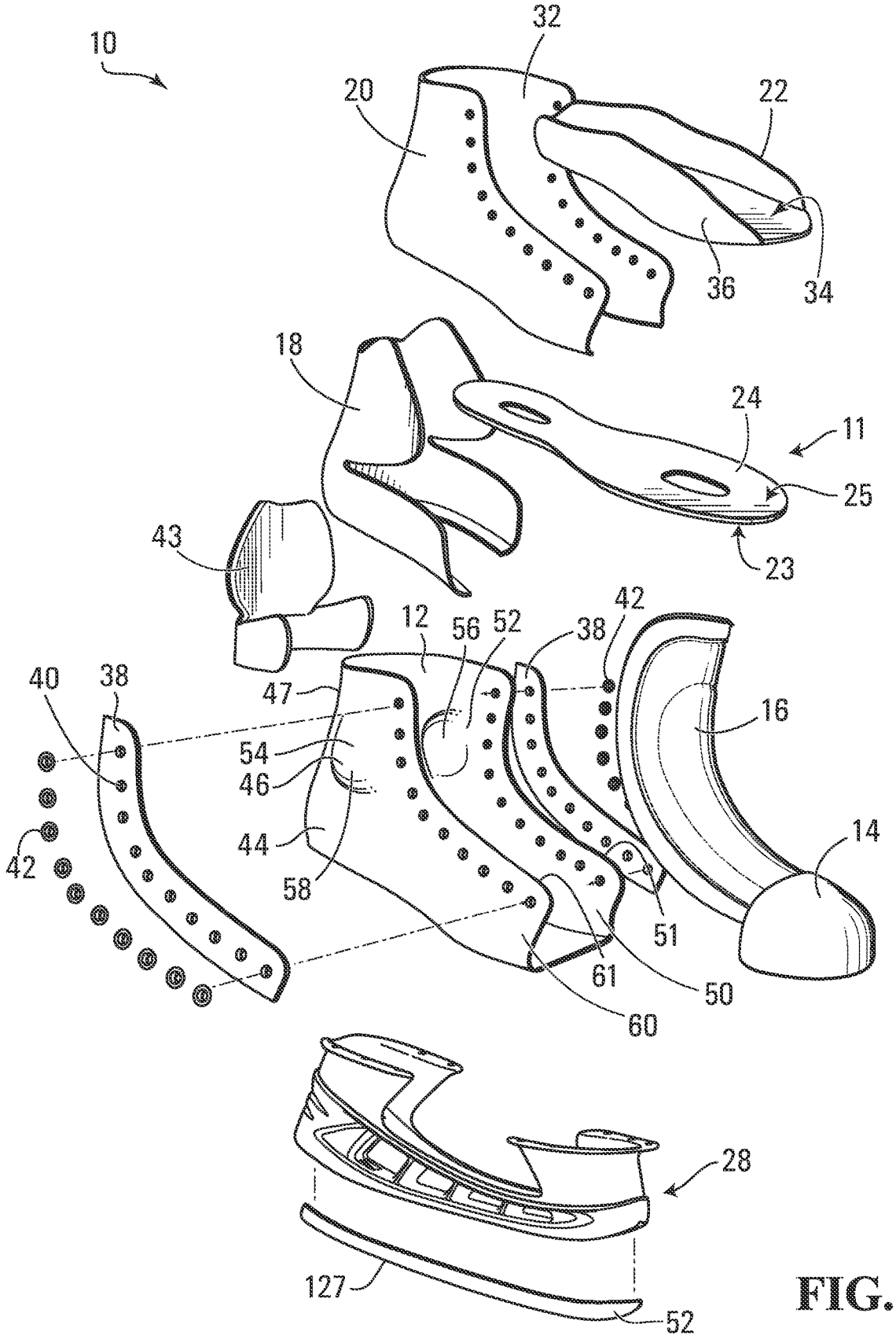
FIG. 2 is an exploded view of the ice skate, including a skate boot, a blade holder, and the blade.
Figure 3:
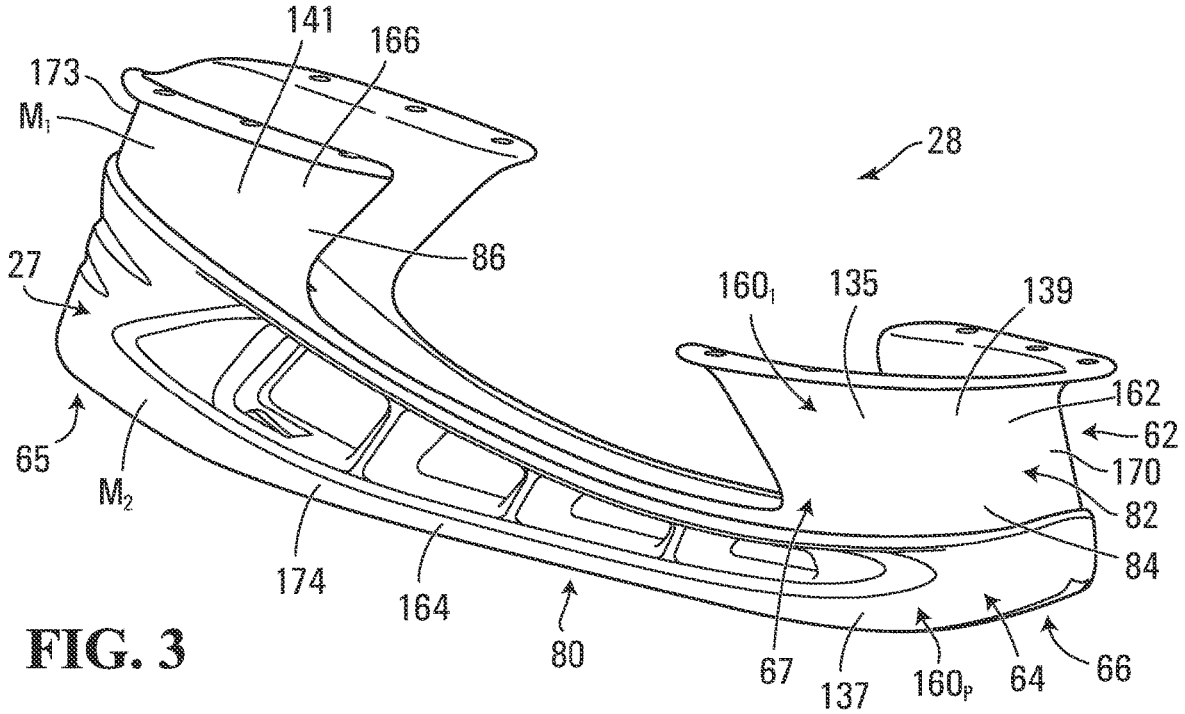
FIGS. 3 to 9 are various views of the blade holder.
Figure 4:
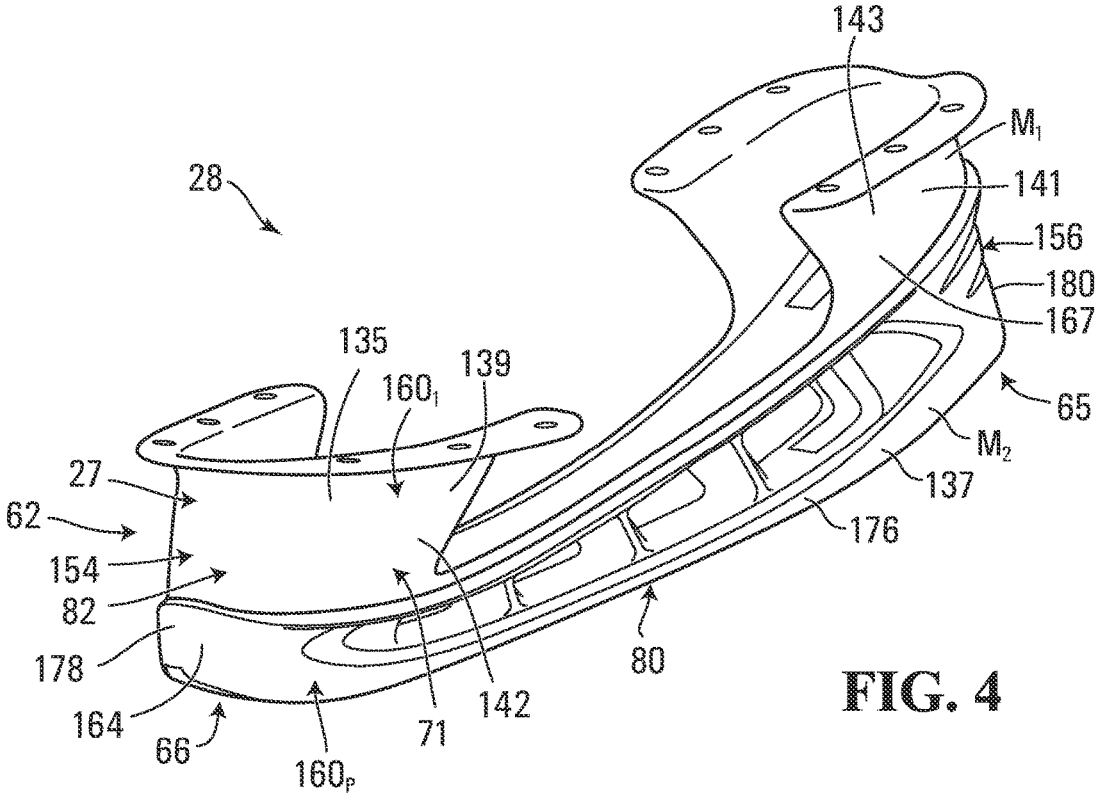
Figure 5:
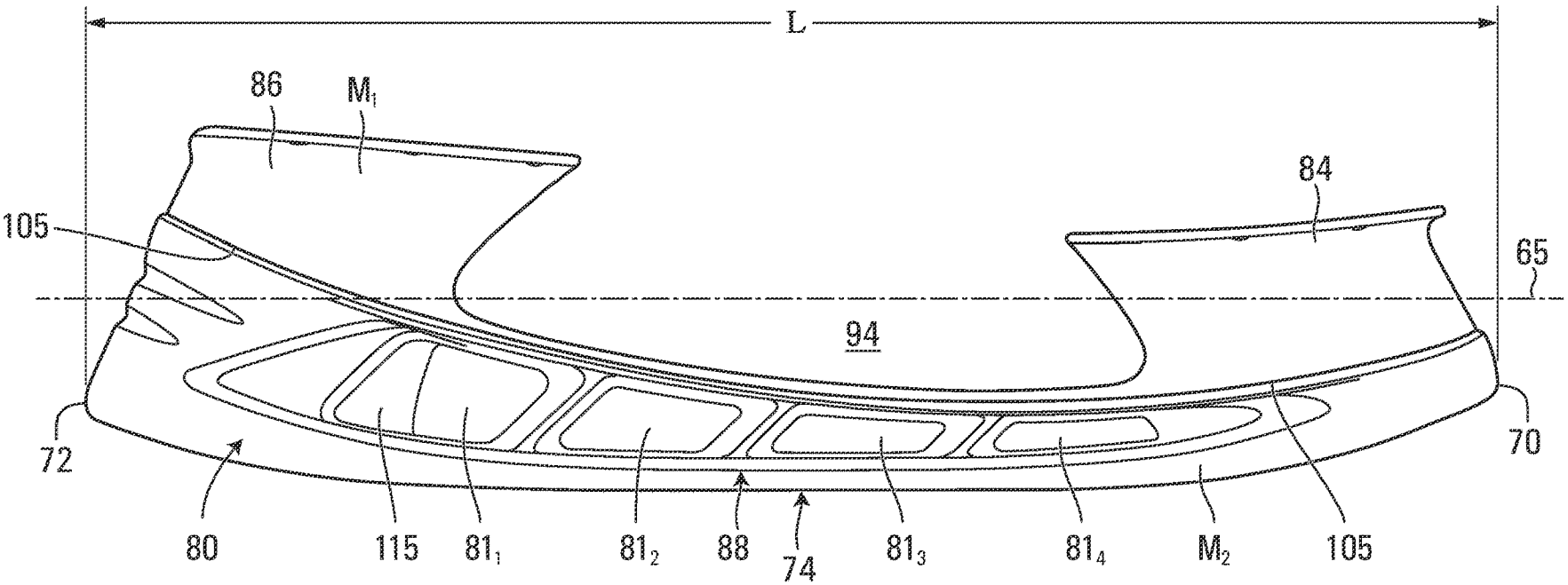
Figure 6:
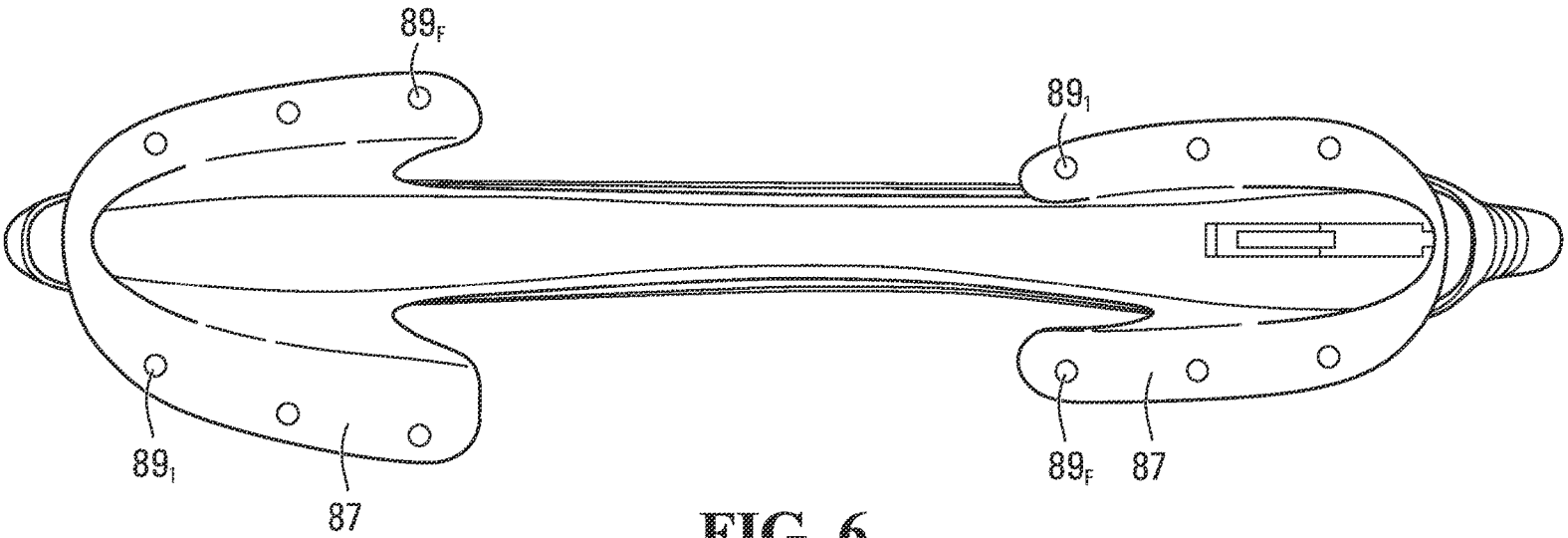
Figure 7:
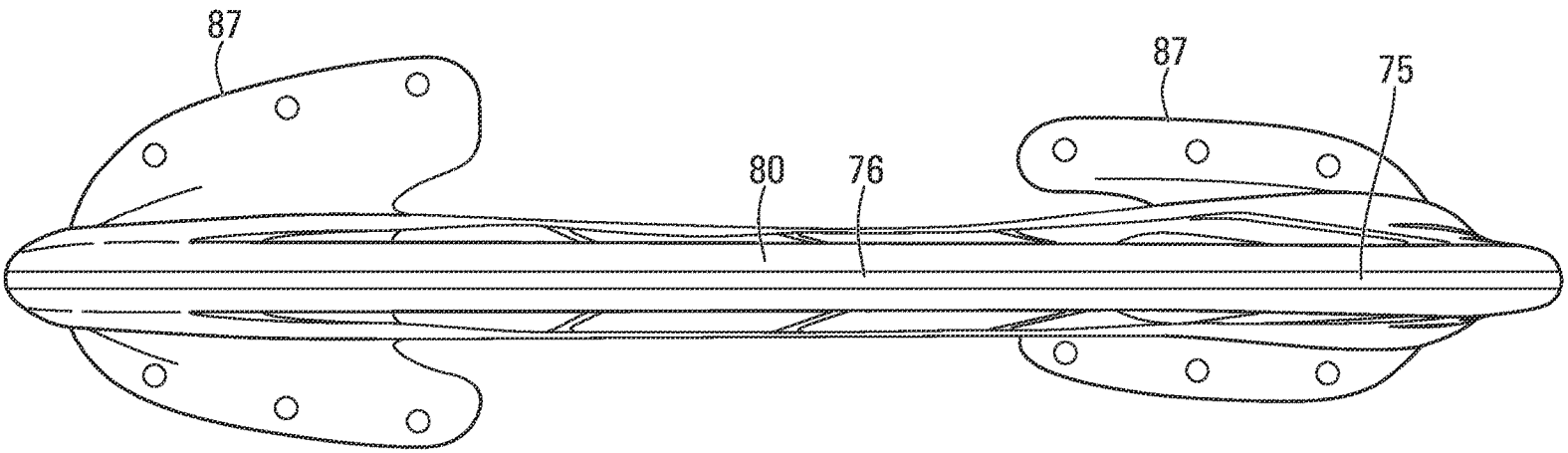
Figure 8:
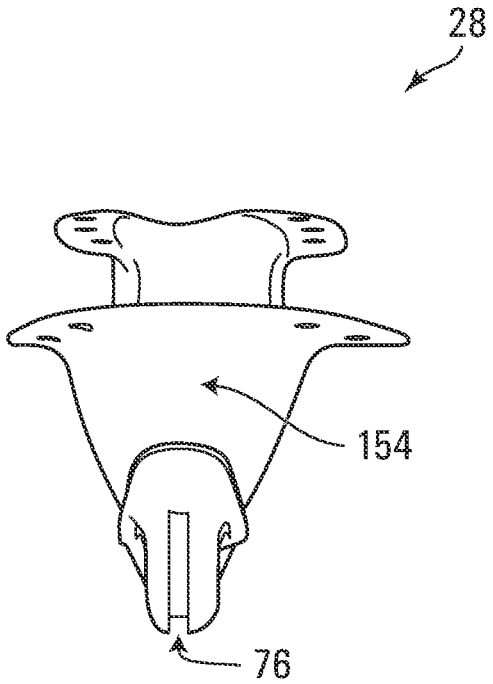
Figure 9:
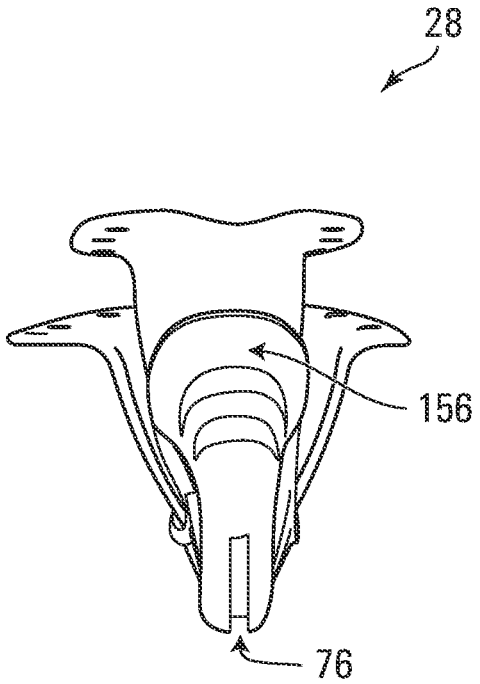

FIGS. 1 and 2 show an example of an ice skate 10 comprising a blade 52 for contacting ice 15 on which a user skates, in accordance with an embodiment of the invention. The ice skate 10 comprises a skate boot 11 for enclosing a foot of the user and a blade holder 28 for holding the blade 52. In this embodiment, the ice skate 10 is a hockey skate designed for playing ice hockey. In other embodiments, the ice skate 10 may be designed for other types of skating activities.

As further discussed below, in this embodiment, the blade 52 is designed to be lightweight yet strong and possibly provide other performance benefits to the user, including by being made of different materials (e.g., at least three different materials) that are strategically arranged and secured to one another.

Figure 40:
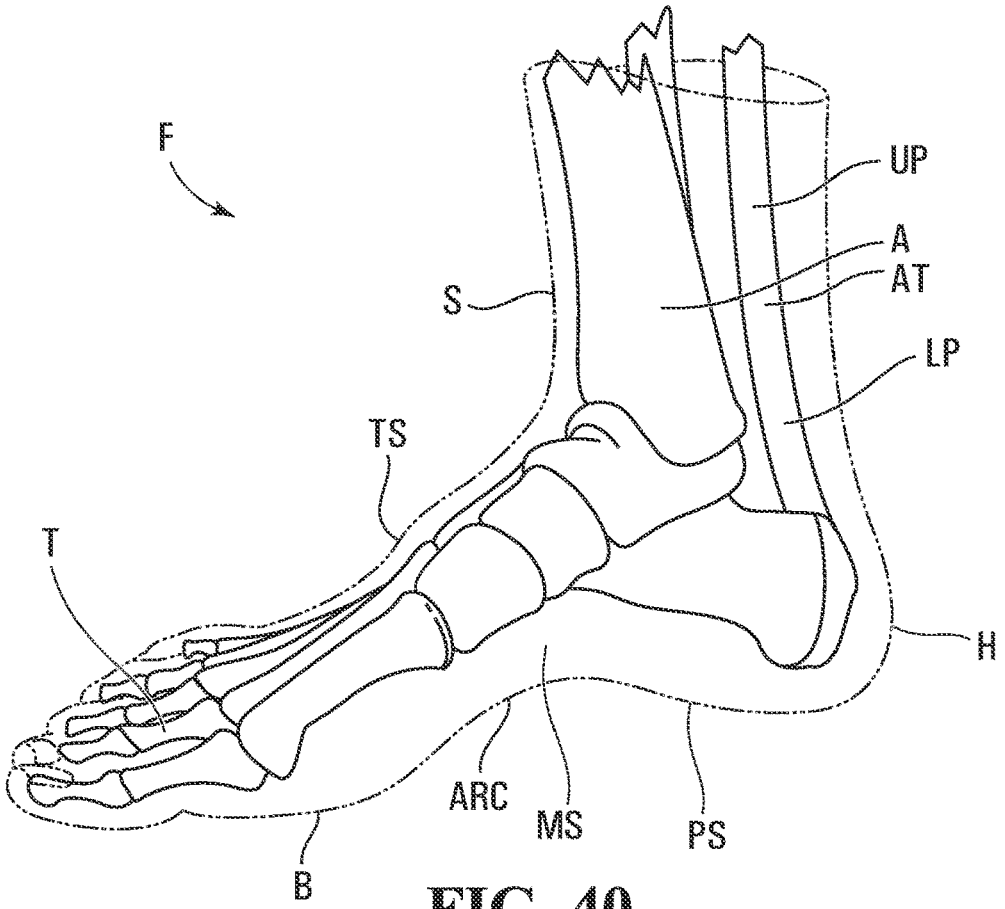
FIGS. 40 and 41 are side and front views of a foot of a user with an integument of the foot shown in dotted lines and bones shown in solid lines.
Figure 41:
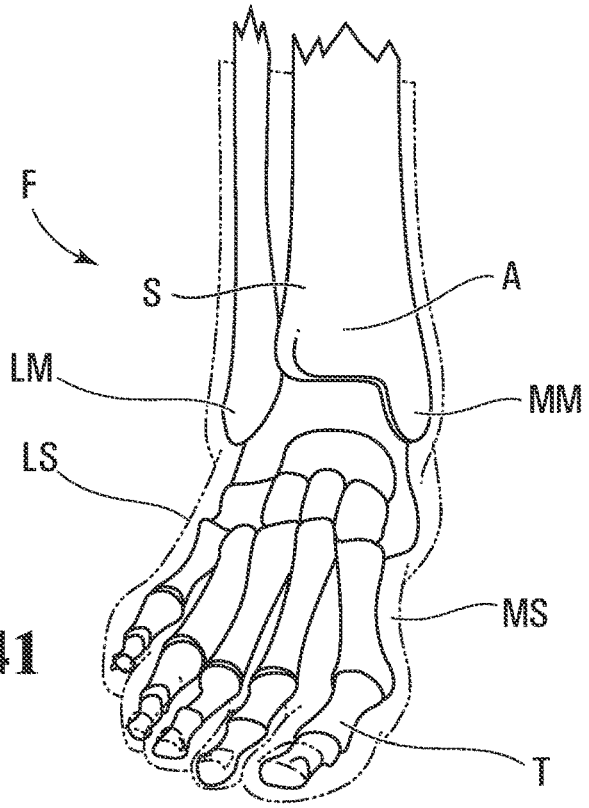

The skate boot 11 defines a cavity 26 for receiving the user's foot. With additional reference to FIGS. 40 and 41, the user's foot includes toes T, a ball B, an arch ARC, a plantar surface PS, a top surface TS, a medial side MS and a lateral side LS. The top surface TS of the user's foot is continuous with a lower portion of the user's shin S. In addition, the user has a heel H, an Achilles tendon AT, and an ankle A having a medial malleolus MM and a lateral malleolus LM that is at a lower position than the medial malleolus MM. The Achilles tendon AT has an upper part UP and a lower part LP projecting outwardly with relation to the upper part UP and merging with the heel H. A forefoot of the user includes the toes T and the ball B, a hindfoot of the user includes the heel H, and a midfoot of the user is between the forefoot and midfoot.

In this embodiment, the skate boot 11 comprises a front portion 17 for receiving the toes T of the user's foot, a rear portion 19 for receiving the heel H of the user's foot, and an intermediate portion 21 between the front portion 17 and the rear portion 19.

More particularly, in this embodiment, the skate boot 11 comprises an outer shell 12, a toe cap 14 for facing the toes T, a tongue 16 extending upwardly and rearwardly from the toe cap 14 for covering the top surface TS of the user's foot, a rigid insert 18 for providing more rigidity around the ankle A and the heel H of the user's foot, an inner lining 20, a footbed 22, and an insole 24. The skate boot 11 also comprises lace members 38 and eyelets 42 punched into the lace members 38, the outer shell 12 and the inner lining 20 vis-A-vis apertures 40 in order to receive a lace for tying on the skate 10.

The outer shell 12 comprises a heel portion 44 for receiving the heel H, an ankle portion 46 for receiving the ankle A, and medial and lateral side portions 50, 60 for facing the medial and lateral sides MS, LS of the user's foot, respectively. In this embodiment, the outer shell 12 is molded (e.g., thermoformed) to form its heel portion 44, its ankle portion 46, and its medial and lateral side portions 50, 60. In this example, the medial and lateral side portions 50, 60 include upper edges 51, 61 which connect to the lace members 38. The heel portion 44 may be formed such that it is substantially cup-shaped for following the contour of the heel H. The ankle portion 46 comprises medial and lateral ankle sides 52, 54. The medial ankle side 52 has a medial cup-shaped depression 56 for receiving the medial malleolus MM and the lateral ankle side 54 has a lateral cup-shaped depression 58 for receiving the lateral malleolus LM of the user. The lateral depression 58 is located slightly lower than the medial depression 56, for conforming to the morphology of the user's foot. The ankle portion 46 further comprises a rear portion 47 facing the lower part LP of the Achilles tendon AT. The rear portion 47 may be thermoformed such that it follows the lower part LP of the Achilles tendon AT. Furthermore, the skate boot 11 also includes a tendon guard 43 affixed to the rear portion 47 of the ankle portion 46 and extending upwardly therefrom.

The inner lining 20 is affixed to an inner surface of the outer shell 12 and comprises an inner surface 32 intended for contact with the heel H and medial and lateral sides MS, LS of the user's foot and the user's ankle A in use. The inner lining 20 may be made of a soft material (e.g., a fabric made of NYLON® fibers or any other suitable fabric). The rigid insert 18 is sandwiched between the outer shell 12 and the inner lining 20 and may be affixed in any suitable way (e.g., glued to the inner surface of the outer shell 12 and stitched along its periphery to the outer shell 12). The footbed 22 is mounted inside the outer shell 12 and comprises an upper surface 34 for receiving the plantar surface PS of the user's foot and a wall 36 projecting upwardly from the upper surface 34 to partially cup the heel H and extend up to a medial line of the user's foot. The insole 24 has an upper surface 25 for facing the plantar surface PS of the user's foot and a lower surface 23 on which the outer shell 12 may be affixed.

The skate boot 11 may be constructed in any other suitable way in other embodiments. For example, in other embodiments, various components of the skate boot 11 mentioned above may be configured differently or omitted and/or the skate boot 11 may comprise any other components that may be made of any other suitable materials and/or using any other suitable processes.

With additional reference to FIGS. 3 to 9, the blade holder 28 comprises a lower portion 64 comprising a blade-retaining base 80 that retains the blade 52 and an upper portion 62 comprising a support 82 that extends upwardly from the blade-retaining base 80 towards the skate boot 11 to interconnect the blade holder 28 and the skate boot 11. A front portion 66 of the blade holder 28 and a rear portion 68 of the blade holder 28 define a longitudinal axis 65 of the blade holder 28. The front portion 66 of the blade holder 28 includes a front 154 of the blade holder 28 and extends beneath and along the user's forefoot in use, while the rear portion 68 of the blade holder 28 includes a rear 156 of the blade holder 28 and extends beneath and along the user's hindfoot in use. An intermediate portion 74 of the blade holder 28 is between the front and rear portions 66, 68 of the blade holder 28 and extends beneath and along the user's midfoot in use. A length L of the blade holder 28 can be measured from a frontmost point 70 to a rearmost point 72 of the blade holder 28. The blade holder 28 comprises a medial side 71 and a lateral side 67 that are opposite one another. The blade holder 28 has a longitudinal direction (i.e., a direction generally parallel to its longitudinal axis 65) and transversal directions (i.e., directions transverse to its longitudinal axis 65), including a widthwise direction (i.e., a lateral direction generally perpendicular to its longitudinal axis 65). The blade holder 28 also has a height direction normal to its longitudinal and widthwise directions.

The blade-retaining base 80 is elongated in the longitudinal direction of the blade holder 28 and is configured to retain the blade 52 such that the blade 52 extends along a bottom portion 73 of the blade-retaining base 80 to contact the ice 15. To that end, the blade-retaining base 80 comprises a blade-retention portion 75 to face and retain the blade 52. In this embodiment, the blade-retention portion 75 comprises a recess 76 in which an upper portion of the blade 52 is disposed.

In this embodiment, the blade-retaining base 80 comprises a plurality of apertures $\mathbf{81}_1$-$\mathbf{81}_4$ distributed in the longitudinal direction of the blade holder 28 and extending from the medial side 71 to the lateral side 67 of the blade holder 28. In this example, respective ones of the apertures $\mathbf{81}_1$-$\mathbf{81}_4$ differ in size. More particularly, in this example, the apertures $\mathbf{81}_1$-$\mathbf{81}_4$ decrease in size towards the front portion 66 of the blade holder 28. The apertures $\mathbf{81}_1$-$\mathbf{81}_4$ may have any other suitable configuration, or may be omitted, in other embodiments.

The blade-retaining base 80 may be configured in any other suitable way in other embodiments.

The support 82 is configured for supporting the skate boot 11 above the blade-retaining base 80 and transmit forces to and from the blade-retaining base 80 during skating. In this embodiment, the support 82 comprises a front pillar 84 and a rear pillar 86 which extend upwardly from the blade-retaining base 80 towards the skate boot 11. The front pillar 84 extends towards the front portion 17 of the skate boot 11 and the rear pillar 86 extends towards the rear portion 19 of the skate boot 11. The blade-retaining base 80 extends from the front pillar 84 to the rear pillar 86. More particularly, in this embodiment, the blade-retaining base 80 comprises a bridge 88 interconnecting the front and rear pillars 84, 86.

The support 82 and the skate boot 11 can be connected to one another in any suitable way. In this embodiment, the support 82 is affixed to the skate boot 11. More particularly, in this embodiment, the front and rear pillars 84, 86 are fastened to the skate boot 11 by fasteners (e.g., rivets, screws, bolts). In this example, each of the front and rear pillars 84, 86 comprises a flange 87 including a plurality of apertures $\mathbf{89}_1$-$\mathbf{89}_F$ to receive respective ones of the fasteners that fasten the blade holder 28 to the skate boot 11. The support 82 may be affixed to the skate boot 11 in any other suitable manner in other embodiments (e.g., by an adhesive).

The support 82 may be configured in any other suitable way in other embodiments.

Figure 16A:
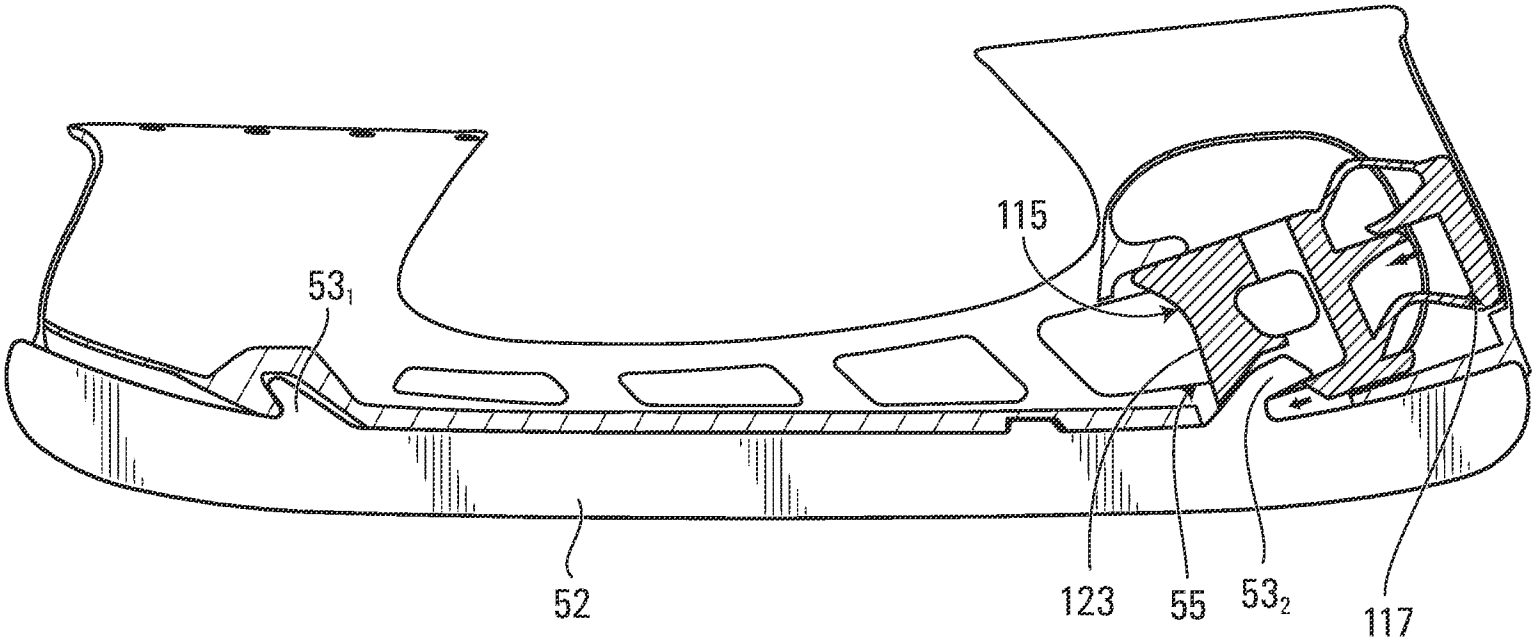
FIGS. 16A to 16C are partial cross-sectional views showing a blade-detachment mechanism of the blade holder.
Figure 16B:
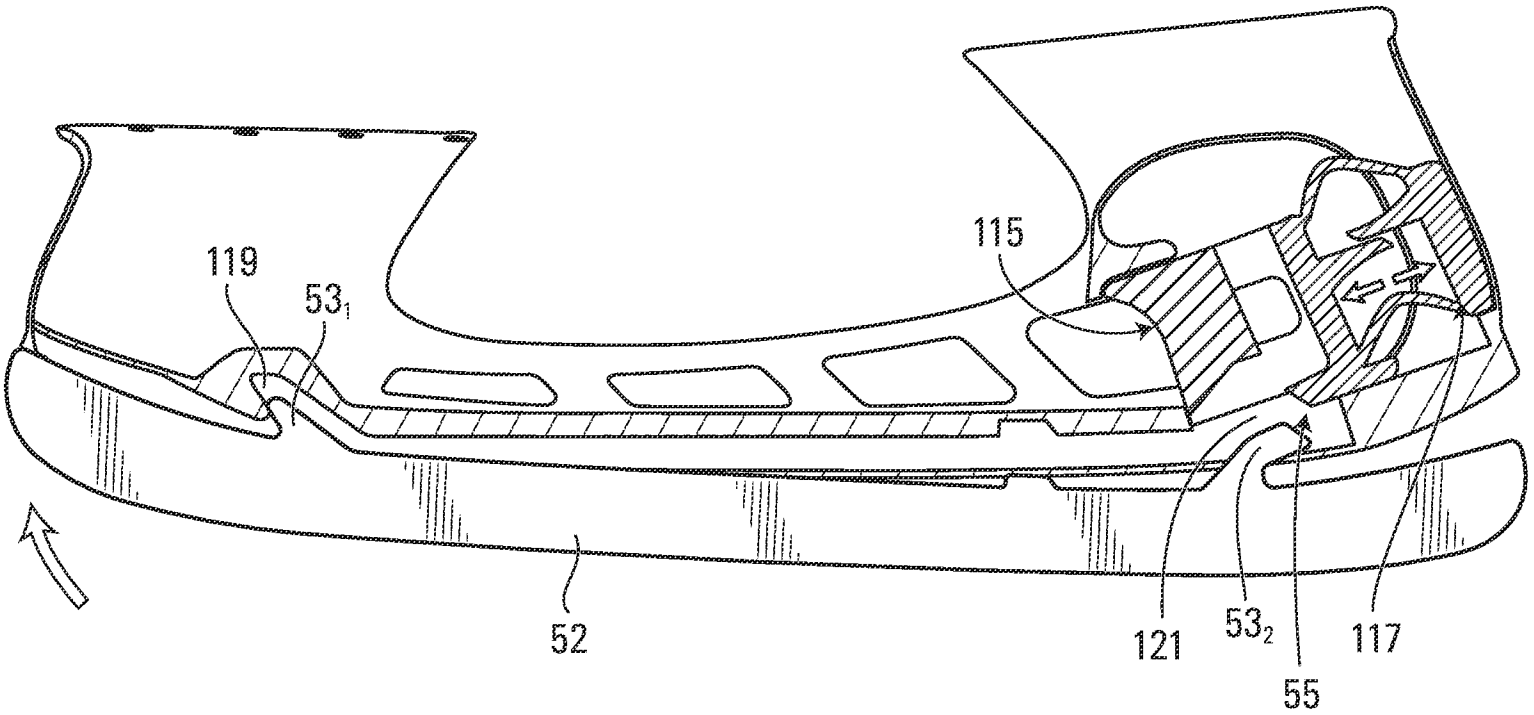
Figure 16C:
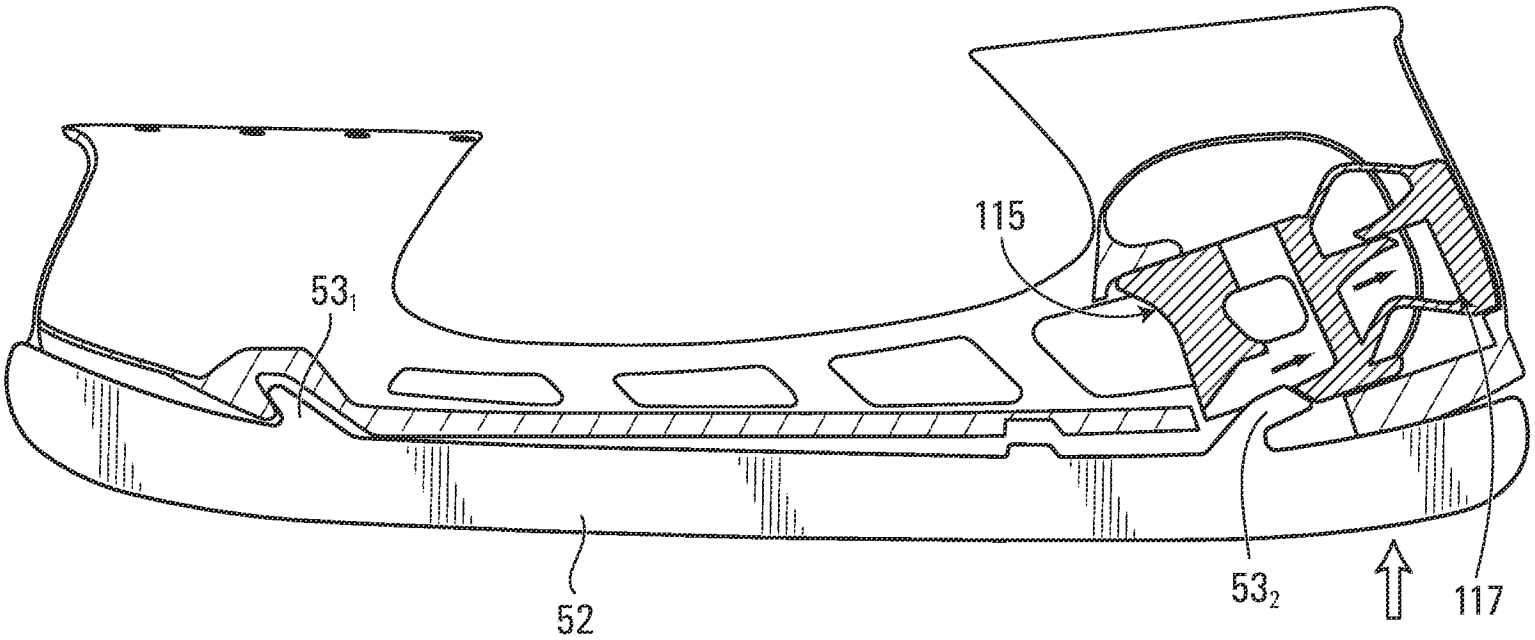

The blade holder 28 can retain the blade 52 in any suitable way. In this embodiment, with additional reference to FIGS. 16A to 16C, as further discussed below, the blade holder 28 comprises a blade-detachment mechanism 55 such that the blade 52 is selectively detachable and removable from, and attachable to, the blade holder 28 (e.g., when the blade 52 is worn out or otherwise needs to be replaced or removed from the blade holder 28).

Figure 10:
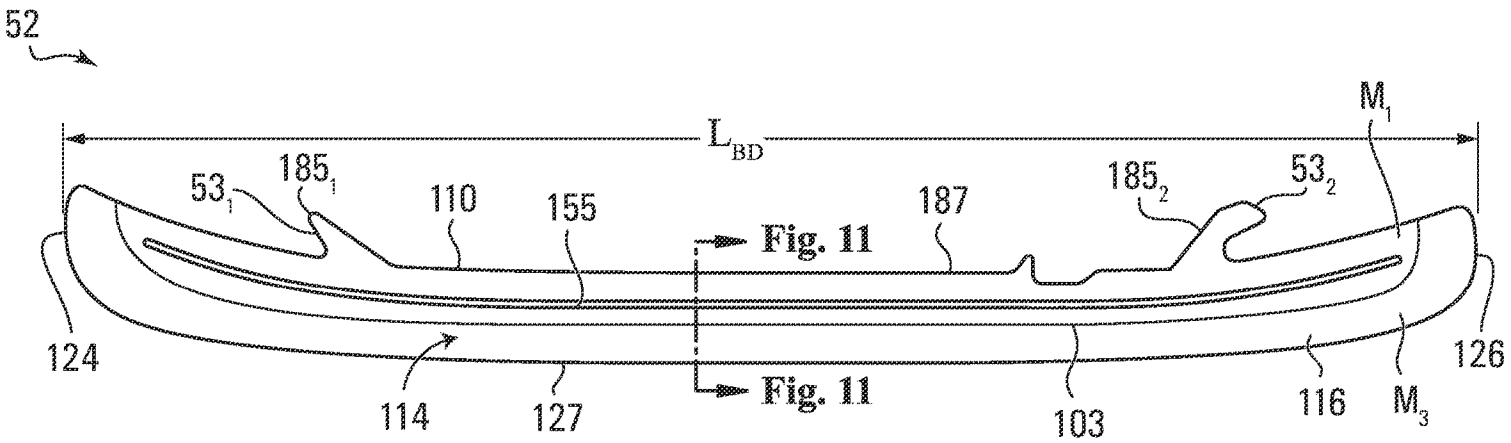
FIG. 10 is a side elevation view of the blade, including an upper member and an ice-contacting lower member of the blade.
Figure 11:
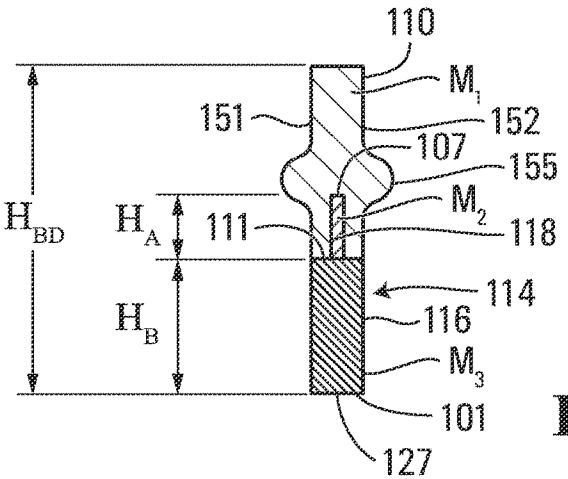
FIG. 11 is a cross-sectional view of the blade as shown in FIG. 10.

As shown in FIGS. 10 and 11, the blade 52 comprises an ice-contacting surface 127 that contacts the ice 15 as the user skates. In this embodiment, the blade 52 comprises a plurality of different materials $M_1$-$M_3$ that constitute respective portions of the blade 52 and are strategically disposed and secured to one another. More particularly, in this embodiment, the blade 52 comprises an upper member 110 that includes the material $M_1$ and an ice-contacting lower member 114 that comprises the ice-contacting surface 127, is secured to the upper member 110, and includes the materials $M_2$, $M_3$. Notably, the ice-contacting lower member 114 comprises a base 116 comprising the ice-contacting surface 127 and including the material $M_3$ and an anchor 118 that includes the material $M_2$ and is affixed to the base 116 and the upper member 110. That is, in this embodiment, the base 116 and the anchor 118 are distinct structures that are affixed to one another as opposed to being integrally formed with one another.

In this embodiment, the material $M_1$ is a polymeric material such that the upper member 110 is a polymeric upper member, while the materials $M_2$, $M_3$ are metallic materials such that the ice-contacting lower member 114 is a metallic ice-contacting lower member.

Figure 14:
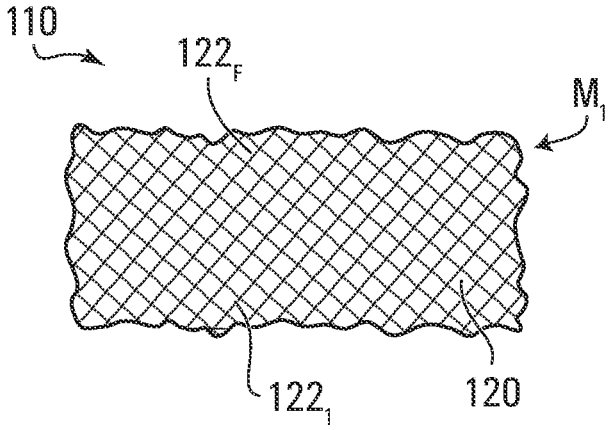
FIG. 14 shows a material of the upper member in an example in which the material is a composite material.

In this example, as shown in FIG. 14, the material $M_1$ is a composite material comprising a polymeric matrix 120 and fibers $\mathbf{122}_1$-$\mathbf{122}_F$ disposed in the polymeric matrix 120 such that the polymeric upper member 110 is a composite upper member. Thus, in this example of implementation, the material $M_1$ is a fiber-reinforced plastic (FRP—a.k.a., fiber-reinforced polymer).

The polymeric matrix 120 may include any suitable substance (e.g., resin). For instance, in some examples, the polymeric matrix 120 may include a thermoplastic or thermosetting resin, such as epoxy, polyethylene, polypropylene, acrylic, thermoplastic polyurethane (TPU), polyether ether ketone (PEEK) or other polyaryletherketone (PAEK), polyethylene terephthalate (PET), polyvinyl chloride (PVC), poly(methyl methacrylate) (PMMA), polycarbonate, acrylonitrile butadiene styrene (ABS), nylon, polyimide, polysulfone, polyamide-imide, self-reinforcing polyphenylene, polyester, vinyl ester, vinyl ether, polyurethane, cyanate ester, phenolic resin, etc., a hybrid thermosetting-thermoplastic resin, or any other suitable resin. In this embodiment, the polymeric matrix 120 includes an epoxy resin.

The fibers $\mathbf{122}_1$-$\mathbf{122}_F$ may be made of any suitable material. In this embodiment, the fibers $\mathbf{122}_1$-$\mathbf{122}_F$ are carbon fibers. The material $M_1$ is thus a carbon-fiber-reinforced plastic in this example of implementation. Any other suitable type of fibers may be used in other embodiments (e.g., polymeric fibers such as aramid fibers (e.g., Kevlar fibers), boron fibers, silicon carbide fibers, metallic fibers, glass fibers, ceramic fibers, etc.).

In this embodiment, the fibers $\mathbf{122}_1$-$\mathbf{122}_F$ are continuous such that they constitute a continuous fiber reinforcement of the material $M_1$. For example, in this embodiment, the fibers $\mathbf{122}_1$-$\mathbf{122}_F$ may be provided as layers of continuous fibers (e.g. pre-preg (i.e., pre-impregnated) layers of fibers held together by an amount of matrix material, which is destined to provide a respective portion of the polymeric matrix 120 of the material $M_1$).

In this example, respective ones of the fibers $\mathbf{122}_1$-$\mathbf{122}_F$ are oriented differently. For example, in some embodiments, the fibers $\mathbf{122}_1$-$\mathbf{122}_F$ are arranged in layers stacked upon one another and may extend parallel or at an oblique angle to a longitudinal axis of the blade 52. For instance, given ones of the fibers $\mathbf{122}_1$-$\mathbf{122}_F$ in the layers that are stacked may be oriented at 0°, +/−45° and +/−90° in an alternating manner. The fibers $\mathbf{122}_1$-$\mathbf{122}_F$ may be arranged in any other suitable way in other examples.

In this embodiment, the base 116 defines a front longitudinal end 124 and a rear longitudinal end 126 of the blade 52 such that a length of the base 116 corresponds to a length $L_{BD}$ of the blade 52 measured from the front longitudinal end 124 to the rear longitudinal end 126. The base 116 has a curved shape defined by curved front and rear longitudinal end portions. The base 116 comprises a bottom edge 101 defining the ice-contacting surface 127 of the blade 52, a top edge 103 opposite the bottom edge 101, and lateral surfaces $\mathbf{131}_1$, $\mathbf{131}_2$ opposite to one another. As shown in FIG. 11, in a cross-section of the blade 52 normal to the ice-contacting surface 127, the base 116 has a height $H_B$ measured from the bottom edge 101 to the top edge 103. Moreover, the base 116 has a width $W_B$ measured from the lateral surface $\mathbf{131}_1$ to the lateral surface $\mathbf{131}_2$.

Figure 12:
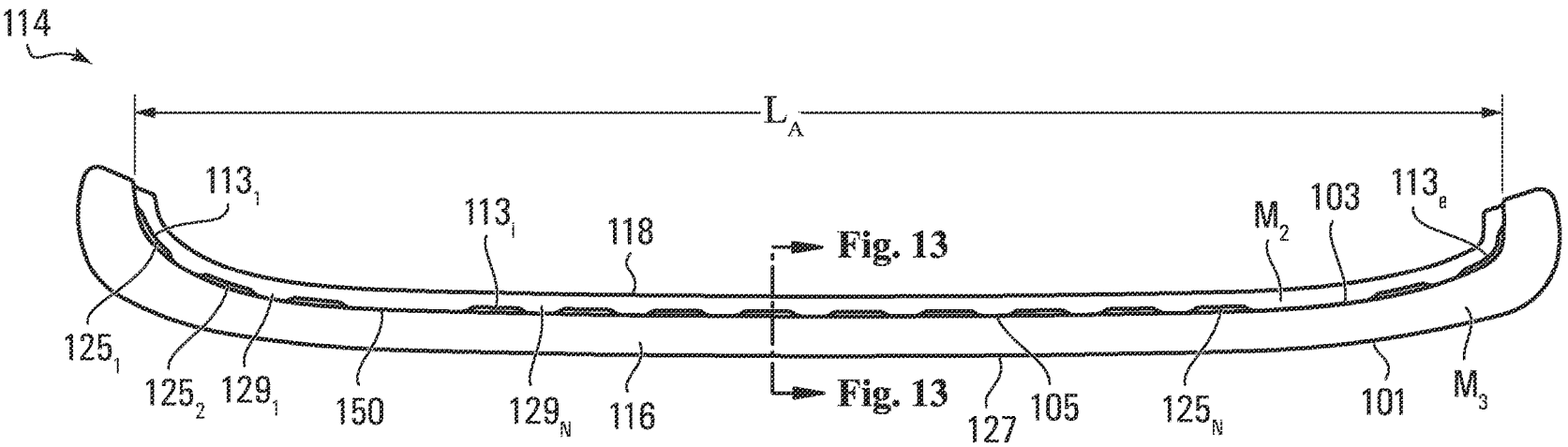
FIG. 12 is a side elevation view of the ice-contacting lower member of the blade.
Figure 13:
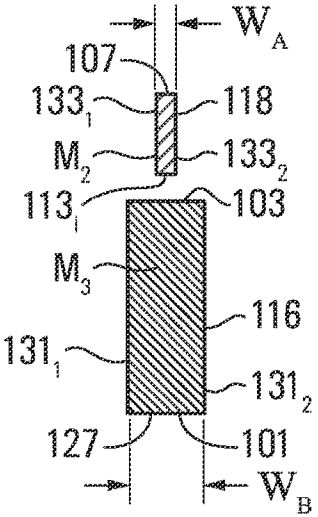
FIG. 13 is a cross-sectional view of the ice-contacting lower member of the blade as shown in FIG. 12.

The anchor 118 is configured to anchor the metallic ice-contacting lower member 114 to the polymeric upper member 110. Moreover, in this example, the anchor 118 also reinforces the polymeric upper member 110. In this embodiment, the anchor 118 has a shape generally corresponding to a curved shape of the base 116 (e.g., a curvature that follows a curvature of the base 116). The anchor 118 comprises a bottom edge 105 for facing the base 116 and a top edge 107 opposite the bottom edge 105 and for facing the polymeric upper member 110. Furthermore, as shown in FIGS. 12 and 13, in this embodiment, the anchor 118 comprises a plurality of recesses $\mathbf{113}_1$-$\mathbf{113}_R$ each of which extends from the bottom edge 105 towards the top edge 107. As will be discussed in more detail below, the recesses $\mathbf{113}_1$-$\mathbf{113}_R$ may aid in securing the metallic ice-contacting lower member 114 to the polymeric upper member 110. The anchor 118 thus comprises a plurality of non-recessed regions $\mathbf{129}_1$-$\mathbf{129}_N$ which are regions of the anchor 118 which do not comprise a recess $\mathbf{113}_1$. As shown in FIG. 11, in a cross-section of the blade 52 normal to the ice-contacting surface 127 (in this case, taken at or near a longitudinal center of the blade 52), the anchor 118 has a height $H_A$ measured from the bottom edge 105 to the top edge 107.

In this embodiment, the height $H_A$ of the anchor 118 is less than the height $H_B$ of the base 116. For instance, in some cases, a ratio of the height $H_A$ of the anchor 118 over the height $H_B$ of the base 116 may be no more than 0.7, in some cases no more than 0.5, in some cases no more than 0.3, in some cases no more than 0.1, and in some cases even less. Furthermore, in some cases, a ratio of the height $H_A$ of the anchor 118 over a height $H_{BD}$ of the blade 52 measured in a cross-section of the blade 52 normal to the ice-contacting surface 127 may be no more than 0.5, in some cases no more than 0.4, in some cases no more than 0.3, in some cases no more than 0.2, in some cases no more than 0.1, and in some cases even less.

In this embodiment, the height $H_A$ of the anchor 118 is less than the height $H_B$ of the base 116 for a significant portion of a length $L_A$ of the anchor 118. More specifically, the height of the $H_A$ of the anchor 118 is less than the height $H_B$ of the base 116 for a majority of the length $L_A$ of the anchor 118. Furthermore, in this embodiment, the height $H_A$ of the anchor 118 is less than the height $H_B$ of the base 116 for a majority of the length $L_{BD}$ of the blade 52. Moreover, the height $H_A$ of the anchor 118 is substantially constant for at least a majority of the length $L_{BD}$ of the blade 52. For example, the height $H_A$ of the anchor 118 may be substantially constant for an entirety of the length $L_{BD}$ of the blade 52.

In some embodiments, the height $H_A$ of the anchor 118 may be the same or greater than the height $H_B$ of the base 116. For instance, in some cases, a ratio of the height $H_A$ of the anchor 118 over the height $H_B$ of the base 116 may be at least 1, in some cases at least 2, in some cases at least 3, and in some cases even more (e.g., 4).

The width $W_A$ of the anchor 118 may be relatively small. For instance, in some cases, a ratio of the width $W_A$ of the anchor 118 over the width $W_B$ of the base 116 may be no more than 0.9, in some cases no more than 0.7, in some cases no more than 0.5, in some cases no more than 0.3, in some cases no more than 0.2, in some cases no more than 0.1, and in some cases even less.

The length $L_A$ of the anchor 118 may be significant relative to the length $L_{BD}$ of the blade 52. For instance, as shown in FIG. 12, the anchor 118 extends for at least a majority of the length $L_{BD}$ of the blade 52 in the longitudinal direction of the blade 52. For example, the anchor 118 may extend for at least three-quarters or more (e.g., the entirety) of the length $L_{BD}$ of the blade 52 in the longitudinal direction of the blade 52. Furthermore, the anchor 118 spans a majority of the top edge 103 of the base 116 in the longitudinal direction of the blade 52. For example, the anchor 118 may span at least three-quarters or more (e.g., an entirety) of the top edge 103 of the base 116 in the longitudinal direction of the blade 52.

In this embodiment, the metallic material $M_3$ of the base 116 is different from the metallic material $M_2$ of the anchor 118. More particularly, in this example of implementation, the metallic material $M_3$ of the base 116 is a stainless steel and, more specifically, a MoV stainless steel (i.e., a stainless steel with a high molybdenum and vanadium content), while the metallic material $M_2$ of the anchor 118 is another stainless steel and, more specifically, a 304 stainless steel.

The stainless steels $M_2$, $M_3$ thus have different properties, and this may help to tailor behavior or performance of different parts of the blade 52.

For example, in this embodiment, the stainless steel $M_3$ of the base 116 has a greater molybdenum content than the stainless steel $M_2$ of the anchor 118. In some cases, the molybdenum content of the stainless steel $M_2$ may be substantially zero (i.e., there may be substantially no molybdenum in that steel). Moreover, in this embodiment, the stainless steel $M_3$ of the base 116 has a greater vanadium content than the stainless steel $M_2$ of the anchor 118. In some cases, the vanadium content of the stainless steel $M_2$ may be substantially zero (i.e., there may be substantially no vanadium in that steel). However, in some cases, the vanadium content of the stainless steel $M_3$ may be substantially zero. Furthermore, in this embodiment, the stainless steel $M_3$ of the base 116 is martensitic while the stainless steel $M_2$ of the anchor 118 is austenitic. This may allow the stainless steel $M_3$ of the base 116, which is exposed (e.g., to the ice 15, impacts, etc.), to perform better than the stainless steel $M_2$ of the anchor 118, which is contained within the polymeric upper member 110. For example, the stainless steel $M_3$ may have a greater hardness (e.g., 55 HRC and over), wear resistance, "sharpenability" (i.e., may be more easily sharpened) and corrosion resistance than the stainless steel $M_2$.

In this embodiment, a corrosion resistance of the metallic material $M_3$ of the base 116 may be greater than a corrosion resistance of the metallic material $M_2$ of the anchor 118.

While in this embodiment the metallic material $M_2$ of the anchor 118 is a stainless steel, it should be noted that the metallic material $M_2$ of the anchor 118 may be another metallic material in other embodiments. For instance, in some embodiments, the metallic material $M_2$ of the anchor 118 may be aluminum (e.g., 6061 aluminum) or another suitable metallic material.

The metallic materials $M_2$, $M_3$ of the anchor 118 and the base 116 may have other properties that differ. For instance, in this embodiment, a density of the metallic material $M_3$ of the base 116 is different from a density of the metallic material $M_2$ of the anchor 118. More specifically, the density of the metallic material $M_3$ of the base 116 may be greater than the density of the metallic material $M_2$ of the anchor 118. For instance, in some cases, a ratio of the density of the metallic material $M_3$ over the density of the metallic material $M_2$ may be at least 1.1, in some cases at least 1.3, in some cases at least 1.5, in some cases at least 1.7, and in some cases even more.

In other embodiments, the density of the metallic material $M_2$ of the anchor 118 may be equal to or greater than the density of the metallic material $M_3$ of the base 116.

Furthermore, in this embodiment, a strength of the metallic material $M_3$ of the base 116 is different from a strength of the metallic material $M_2$ of the anchor 118. For example, the strength of the metallic material $M_3$ of the base 116 may be greater than the strength of the metallic material $M_2$ of the anchor 118. For instance, in some cases, a ratio of the strength of the metallic material $M_3$ over the strength of the metallic material $M_2$ may be at least 1.2, in some cases at least 1.4, in some cases at least 1.6, in some cases at least 2, in some cases at least 3, in some cases at least 5, in some cases at least 10, in some cases at least 20, in some cases at least 50 and in some cases even more.

The anchor 118 is affixed to the base 116 after shaping of the base 116. This may be done in various ways. In this embodiment, the anchor 118 is welded to the base 116 (e.g., via laser welding) such that the metallic materials $M_2$, $M_3$ of the anchor 118 and the base 116 are fused to one another. This may provide a strong bond between the anchor 118 and the base 116. To that end, the metallic materials $M_2$, $M_3$ of the anchor 118 and the base 116 are chosen to be weldable with one another (i.e., the materials $M_2$, $M_3$ can be welded to one another). For instance, in this example, the MoV stainless steel of the base 116 is welding compatible with the 304 stainless steel of the anchor 118.

With reference to FIG. 11, the polymeric upper member 110 comprises a first lateral surface 151 and a second lateral surface 152 opposite the first lateral surface 151. In this embodiment, each of the first and second lateral surfaces 151, 152 comprises a projection 155 that projects laterally outwardly relative to an adjacent portion of a respective one of the first and second lateral surfaces 151, 152. The projection 155 acts as a reinforcement to stiffen the polymeric upper member 110. In this example, the projection 155 extends in the longitudinal direction of the blade 52 for at least a majority of the length $L_{BD}$ of the blade 52. In this case, the projection 155 extends in the longitudinal direction of the blade 52 for at least three-quarters or more of the length $L_{BD}$ of the blade 52.

Figure 31:
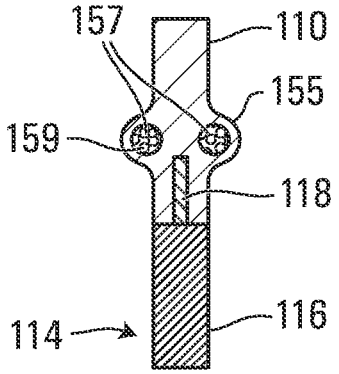
FIG. 31 shows a cross-section of the blade in accordance with an embodiment in which a projection on each lateral surface of the upper member comprises an insert.

In some embodiments, as shown in FIG. 31, the projection 155 on a given one (or both) of the first and second lateral surfaces 151, 152 may comprise an insert 157 disposed therein. The insert 157 comprises a material 159 that is different from the material $M_1$ of the polymeric upper member 110. More particularly, the material 159 has density that is less than a density of the material $M_1$. For instance, in one example of implementation, the material 159 may comprise foam.

In this example, as shown in FIG. 11, in a cross-section of the blade 52 normal to the ice-contacting surface 127, the anchor 118 does not extend above the projection 155 in a heightwise direction of the blade 52. More particularly, in this example, in a cross-section of the blade 52 normal to the ice-contacting surface 127, the anchor 118 extends to the projection 155 in the heightwise direction of the blade 52, without extending above the projection 155.

In this embodiment, the polymeric upper member 110 comprises a plurality of connectors $\mathbf{185}_1$, $\mathbf{185}_2$ to connect the blade 52 to the blade holder 28. The connectors $\mathbf{185}_1$, $\mathbf{185}_2$ are spaced apart from the metallic ice-contacting lower member 114. There is no metallic material in the connectors $\mathbf{185}_1$, $\mathbf{185}_2$, i.e., the connectors $\mathbf{185}_1$, $\mathbf{185}_2$ are free of metallic material, and are made of the polymeric material $M_1$ of the polymeric upper member 110. This may help to reduce the weight of the blade 52, improve its flexing characteristics (i.e., the blade 52 may be more flexible), and/or facilitate manufacturing of the blade 52.

More particularly, the connectors $\mathbf{185}_1$, $\mathbf{185}_2$ extend upwardly from a top surface of the blade 52. In this embodiment, the connectors $\mathbf{185}_1$, $\mathbf{185}_2$ comprise hooks $\mathbf{53}_1$, $\mathbf{53}_2$ that project upwardly from a top edge 187 of the polymeric upper member 110, with the hook $\mathbf{53}_1$ being a front hook and the hook $\mathbf{53}_2$ being a rear hook. The blade-detachment mechanism 55 includes an actuator 115 and a biasing element 117 which biases the actuator 115 in a direction towards the front portion 66 of the blade holder 28. To attach the blade 52 to the blade holder 28, the front hook $\mathbf{53}_1$ is first positioned within a hollow space 119 (e.g., a recess or hole) of the blade holder 28. The rear hook $\mathbf{53}_2$ can then be pushed upwardly into a hollow space 121 (e.g., a recess or hole) of the blade holder 28, thereby causing the biasing element 117 to bend and the actuator 115 to move in a rearward direction. The rear hook $\mathbf{53}_2$ will eventually reach a position which will allow the biasing element 117 to force the actuator 115 towards the front portion 66 of the blade holder 28, thereby locking the blade 52 in place. The blade 52 can then be removed by pushing against a finger-actuating surface 123 of the actuator 115 to release the rear hook $\mathbf{53}_2$ from the hollow space 121 of the blade holder 28. Further information on examples of implementation of the blade-detachment mechanism 55 in some embodiments may be obtained from U.S. Pat. No. 8,454,030 hereby incorporated by reference herein. The blade-detachment mechanism 55 may be configured in any other suitable way in other embodiments.

The polymeric upper member 110 may be secured to the metallic ice-contacting lower member 114 in various ways. For instance, in some embodiments, the polymeric upper member 110 may be bonded by adhesion to the metallic ice-contacting lower member 114. For example, in some embodiments, the adhesion may be chemical adhesion of the polymeric upper member 110 to the metallic ice-contacting lower member 114. Notably, in some embodiments, a resin constituting the polymeric matrix 120 of the material $M_1$ of the polymeric upper member 110 may bond to the metallic ice-contacting lower member 114 (i.e., the resin could act as an adhesive without the addition of an actual adhesive). Furthermore, in some embodiments, the base 116 and the anchor 118 may be surface treated to improve chemical bonding between the polymeric upper member 110 and the metallic ice-contacting lower member 114 (i.e., the base 116 and the anchor 118).

Figure 15:
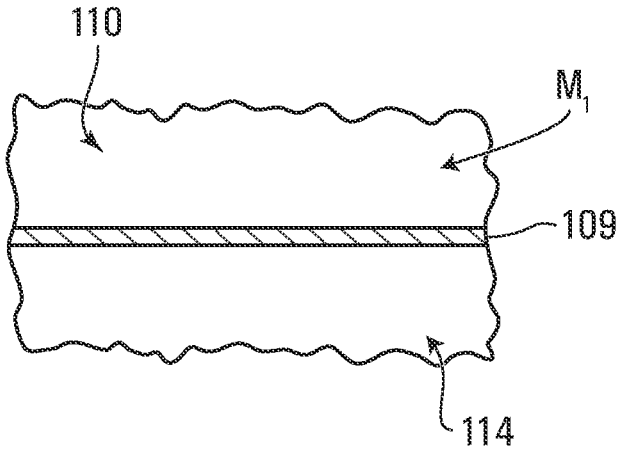
FIG. 15 shows an example in which there is an adhesive between the upper member and the ice-contacting lower member.

Alternatively or additionally, as shown in FIG. 15, the adhesion may comprise an adhesive 109 disposed between the polymeric upper member 110 and the metallic ice-contacting lower member 114. The adhesive 109 may be an epoxy-based adhesive, a polyurethane-based adhesive, an acrylic-based adhesive, cyanoacrylate, silane-modified polymers, methacrylate or any suitable adhesive.

In this embodiment, the polymeric upper member 110 is overmolded onto the metallic ice-contacting lower member 114. That is, the material $M_1$ of the polymeric upper member 110 is overmolded onto the materials $M_2$, $M_3$ of the anchor 118 and the base 116 of the metallic ice-contacting lower member 114. Overmolding of the material $M_1$ onto the materials $M_2$, $M_3$ retains together the material $M_1$ to the materials $M_2$, $M_3$ at an interface 111 between the polymeric upper member 110 and the metallic ice-contacting lower member 114. That is, as the material $M_1$ cures after being overmolded onto the materials $M_2$, $M_3$, respective surfaces of the polymeric upper member 110 and the metallic ice-contacting lower member 114, which constitute the interface 111, are retained together.

More particularly, in this embodiment, the polymeric upper member 110 is mechanically interlocked with the metallic ice-contacting lower member 114. That is, the material $M_1$ of the polymeric upper member 110 and the materials $M_2$, $M_3$ of the metallic ice-contacting lower member 114 are in a mechanical interlock relationship in which they are interconnected via an interlocking part of the blade 52 made of a given one of (i) the material $M_1$ of the polymeric upper member 110 and (ii) the materials $M_2$, $M_3$ of the metallic ice-contacting lower member 114 extending into an interlocking space (e.g., one or more holes, one or more recesses, and/or one or more other hollow areas) of the blade 52 made of the other one of (i) the material $M_1$ of the polymeric upper member 110 and (ii) the materials $M_2$, $M_3$ of the metallic ice-contacting lower member 114.

In this example, a portion of the material $M_1$ of the polymeric upper member 110 constitutes an interlocking part that extends into, in this case, through, a plurality of openings $\mathbf{125}_1$-$\mathbf{125}_N$ of the metallic ice-contacting lower member 114 that are formed by the recesses $\mathbf{113}_1$-$\mathbf{113}_R$ of the anchor 118 and the top edge 103 of the base 116 and that constitute an interlocking space. For example, in some embodiments, respective portions of the polymeric upper member 110 comprising portions of pre-impregnated composite material are passed through the openings $\mathbf{125}_1$-$\mathbf{125}_N$. This mechanical interlock of the polymeric upper member 110 to the metallic ice-contacting lower member 114 may further reinforce retention between the polymeric upper member 110 and the metallic ice-contacting lower member 114.

In some embodiments, alternatively or additionally to forming the openings $\mathbf{125}_1$-$\mathbf{125}_N$ with the base 116, the anchor 118 may include one or more openings (e.g., holes) that can receive the material $M_1$ of the polymeric upper member 110 to mechanically interlock the polymeric upper member 110 and the metallic ice-contacting lower member 114.

Moreover, in some embodiments, instead of or in addition to being mechanically interlocked with the metallic ice-contacting lower member 114, the polymeric upper member 110 may also be bonded by adhesion to the metallic ice-contacting lower member 114, such as by applying the adhesive 109 at the interface 111 between the polymeric upper member 110 and the ice-contacting lower member 114. This may help distribute stress at the interface 111 between the polymeric upper member 110 and the ice-contacting lower member 114 (i.e., reduce punctual stresses at particular locations of the interface 111).

The ice skate 10, including the blade 52, may be implemented in any other suitable way in other embodiments.

Figure 17:
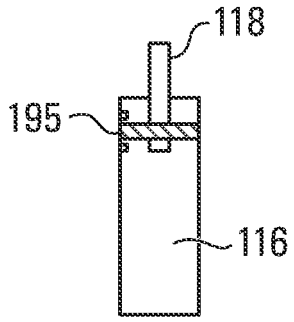
FIG. 17 shows a variant in which an anchor of the ice-contacting lower member is fastened to a base of the ice-contacting lower member by a mechanical fastener.

For example, in some embodiments, instead of or in addition to being welded to the base 116, the anchor 118 may be fastened to the base 116. For example, as shown in FIG. 17, the anchor 118 may be fastened to the base 116 via one or more fasteners 195. For instance, each of the one or more fasteners 195 may engage an opening in the base 116 and a corresponding opening in the anchor 118. The opening of the anchor 118 may be threaded to securely engage a corresponding one of the fasteners 195. Each fastener 195 may be a rivet, a screw, a bolt, or any other suitable mechanical fastener.

Figure 26:
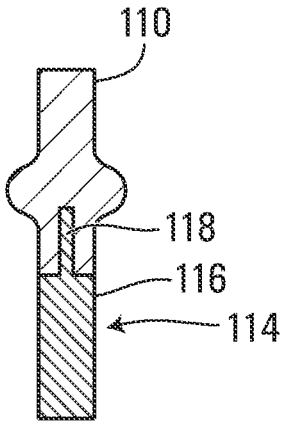
FIG. 26 shows a cross-section of the blade in an example of a variant in which the anchor and the base are integral with one another.

Furthermore, in some embodiments, as shown in FIG. 26, the anchor 118 and the base 116 may be integral with one another such that the anchor 118 and the base 116 form a one-piece unitary structure (i.e., the metallic ice-contacting lower member 114 is a one-piece structure). In such embodiments, the anchor 118 and the base 116 are not welded or otherwise fastened to one another but rather are formed of a same continuous material. Thus, in one example of implementation, the anchor 118 and the base 116 may be formed from a common sheet of material. In order to form the anchor 118 such that the width $W_A$ of the anchor 118 is smaller than the width $W_B$ of the base 116, the common sheet of material may be selectively compressed or machined in order to reduce a thickness of the sheet at a selected region corresponding to the anchor 118. Moreover, the openings $\mathbf{125}_1$-$\mathbf{125}_N$ may be cut-outs (i.e., holes) formed in the unitary structure constituting the metallic ice-contacting lower member 114.

Figure 18:
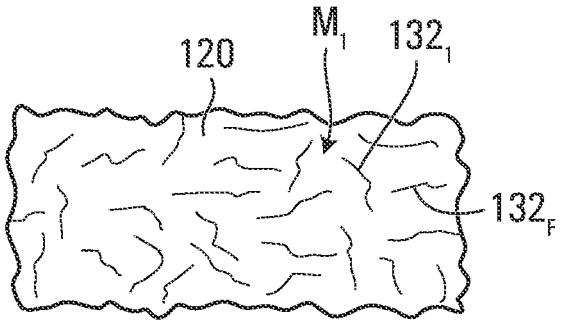
FIG. 18 shows a variant in which the material of the upper member is a composite material comprising chopped fibers.

As another example, in some embodiments, as shown in FIG. 18, the composite material $M_1$ may comprise chopped fibers. That is, rather than comprising the continuous fibers $\mathbf{122}_1$-$\mathbf{122}_F$, the material $M_1$ of the polymeric upper member 110 may comprise chopped fibers $\mathbf{132}_1$-$\mathbf{132}_F$ interspersed within it (i.e., within the polymeric matrix 120). This may provide reinforcement to the material $M_1$.

Figure 19:
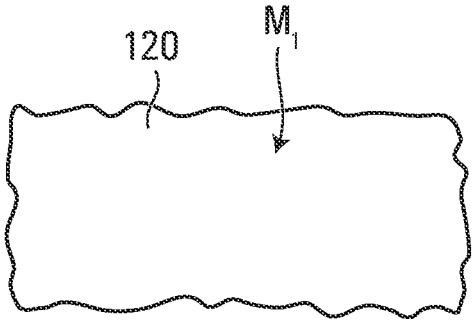
FIG. 19 shows a variant in which the material of the upper member is unreinforced.

As yet another example, in some embodiments, the polymeric material $M_1$ of the polymeric upper member 110 may be a non-composite polymeric material (i.e., not a composite material). In other words, the polymeric material $M_1$ may not have any fibers or other reinforcement. For example, as shown in FIG. 19, the polymeric material $M_1$ may simply comprise only a polymer without any fibers interspersed within it.

In accordance with a variant, the polymeric upper member 110 may be molded separately from the metallic ice-contacting lower member 114 and joined to the ice-contacting lower member 114 afterward. For example, this may be achieved by applying an adhesive at the interface 111 between the polymeric upper member 110 and the metallic ice-contacting lower member 114, or by welding and/or mechanically fastening the polymeric upper member 110 to the metallic ice-contacting lower member 114.

Figure 27:
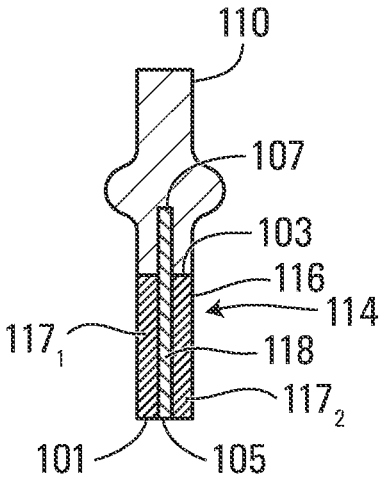
FIG. 27 shows a cross-section of the blade in an example of a variant in which the base comprises a plurality of layers sandwiching the anchor.

In another example of a variant, as shown in FIG. 27, the base 116 may comprise two layers $\mathbf{117}_1$, $\mathbf{117}_2$ between which the anchor 118 is disposed (i.e., the anchor 118 is sandwiched between the layers $\mathbf{117}_1$, $\mathbf{117}_2$ of the base 116). Moreover, in this example of implementation, the height $H_A$ of the anchor 118 is greater than the height $H_B$ of the base 116 and, since in this example the bottom edge 105 of the anchor 118 is flush with the bottom edge 101 of the base 116, the anchor 118 protrudes from the base 116 in the heightwise direction of the blade 52 (i.e., the top edge 107 of the anchor 118 is higher, in the heightwise direction of the blade 52, than the top edge 103 of the base 116). The layers $\mathbf{117}_1$, $\mathbf{117}_2$ of the base 116 may be connected to the anchor 118 by welding, mechanical attachment (e.g., fasteners or rivets) and/or via an adhesive.

Figure 28:
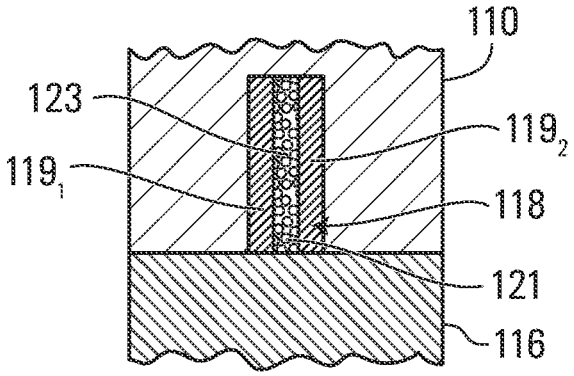
FIG. 28 shows a cross-section of the blade in an example of a variant in which the anchor comprises a plurality of outer layers and an inner layer disposed between the outer layers.

In another example of a variant, as shown in FIG. 28, the anchor 118 may comprise outer layers $\mathbf{119}_1$, $\mathbf{119}_2$ and an inner layer 121 disposed between the outer layers $\mathbf{119}_1$, $\mathbf{119}_2$ (i.e., the inner layer 121 is sandwiched between the outer layers $\mathbf{119}_1$, $\mathbf{119}_2$). The inner layer 121 may comprise a material 123 that has a density that is smaller than the density of the metallic material $M_2$ of the outer layers $\mathbf{119}_1$, $\mathbf{119}_2$ of the anchor 118. For instance, in this example of implementation, the material 123 may be a foam. In another example, the inner layer 121 may not comprise a material at all, but may be an empty space containing air. In other words, the anchor 118 may comprise a hollow structure. This may help reduce the weight of the blade 52.

Figure 29:
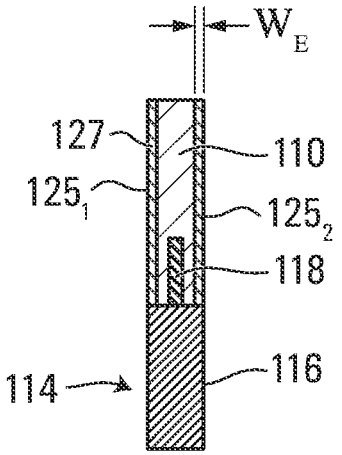
FIG. 29 shows a cross-section of the blade in an example of a variant in which the upper member is disposed between external layers.

In another example of a variant, as shown in FIG. 29, the polymeric upper member 110 may be disposed, in a widthwise direction of the blade 52, between a first external layer $\mathbf{125}_1$ and a second external layer $\mathbf{125}_2$ (i.e., the polymeric upper member 110 may be sandwiched, laterally, between the external layers $\mathbf{125}_1$, $\mathbf{125}_2$). Each of the first and second external layers $\mathbf{125}_1$, $\mathbf{125}_2$ comprises a non-polymeric material 127. In this example of implementation, the non-polymeric material 127 is a metallic material (e.g., stainless steel). The first and second external layers $\mathbf{125}_1$, $\mathbf{125}_2$ may be relatively thin. For instance, each external layer $\mathbf{125}_i$ has a width $W_E$ that is significantly less than the width $W_B$ of the base 116. For example, in some cases, a ratio $W_E/W_B$ of the width $W_E$ of the external layer $\mathbf{125}_i$ over the width $W_B$ of the base 116 may be no more than 0.3, in some cases no more than 0.2, in some cases no more than 0.1 and in some cases even less. In such a variant, the metallic material of the blade 52 thus spans the entire height $H_{BD}$ of the blade 52. This may help stiffen the blade 52 and, in this example, the projection 155 of the lateral surfaces 151, 152 of the polymeric upper member 110 may thus not be included. However, in other examples, the projection 155 may still be implemented with the first and second external layers $\mathbf{125}_1$, $\mathbf{125}_2$.

Figure 30:
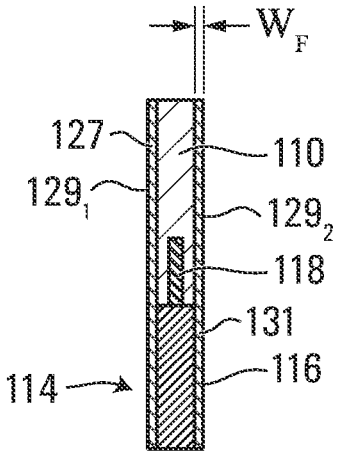
FIG. 30 shows a cross-section of the blade in an example of a variant in which the upper member and the base are disposed between external layers.

In another example of a variant, as shown in FIG. 30, the polymeric upper member 110 and the base 116 may be disposed, in the widthwise direction of the blade 52, between first and second external layers $\mathbf{129}_1$, $\mathbf{129}_2$. Each of the first and second external layers $\mathbf{129}_1$, $\mathbf{129}_2$ comprises a non-polymeric material 131. In this example of implementation, the non-polymeric material 131 is a metallic material (e.g., stainless steel). The first and second external layers $\mathbf{129}_1$, $\mathbf{129}_2$ may be relatively thin. For instance, each external layer $\mathbf{129}_i$ has a width $W_F$ that is significantly less than the width $W_B$ of the base 116. For example, in some cases, a ratio $W_F/W_B$ of the width $W_F$ of the external layer $\mathbf{129}_1$ over the width $W_B$ of the base 116 may be no more than 0.3, in some cases no more than 0.2, in some cases no more than 0.1 and in some cases even less. The inclusion of the first and second external layers $\mathbf{129}_1$, $\mathbf{129}_2$ may help stiffen the blade 52 while offering a homogeneous appearance to the blade 52 (i.e., no visible discontinuity between the polymeric upper member 110 and the metallic ice-contacting lower member 114).

Figure 32:
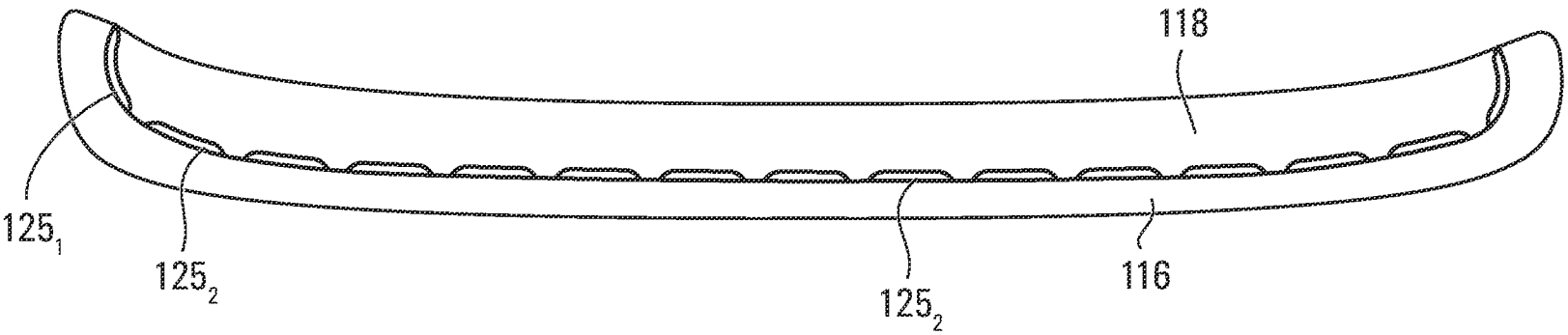
FIG. 32 shows a side elevation view of the ice-contacting lower member in an example of a variant in which the anchor extends along a majority of a height of the upper member of the blade.
Figure 33:
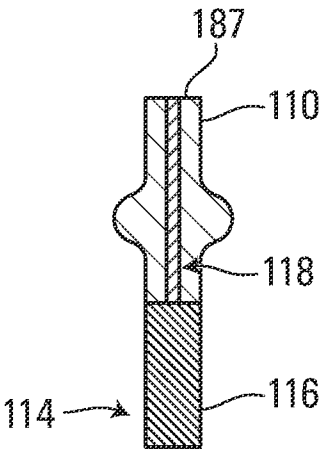
FIG. 33 shows a cross-section of the blade of FIG. 32.

In an example of a variant, as shown in FIGS. 32 and 33, the anchor 118 may extend along at least a majority (i.e., a majority or an entirety) of a height $H_P$ of the polymeric upper member 110. For instance, in some cases, a ratio $H_A/H_P$ of the height $H_A$ of the anchor 118 over the height $H_P$ of the polymeric upper member 110 may be at least 0.5, in some cases at least 0.7, in some cases at least 0.9, in some cases at least 1 and in some cases even more. In this example of implementation, the height $H_A$ of the anchor 118 corresponds to the height $H_P$ of the polymeric upper member 110. Moreover, in this example, the top edge 107 of the anchor 118 corresponds to the top edge 187 of the polymeric upper member 110 such that the anchor 118 and the polymeric upper member 110 are co-extensive in the heightwise direction of the blade 52. This significant height of the anchor 118 may further stiffen the blade 52. As such, in this variant, the width $W_A$ of the anchor 118 may be made particularly small. For example, in some cases, a ratio $W_A$MB of the width $W_A$ of the anchor 118 over the width $W_B$ of the base 116 may be no more than 0.3, in some cases no more than 0.2, in some cases no more than 0.1 and in some cases even less.

Figure 34:
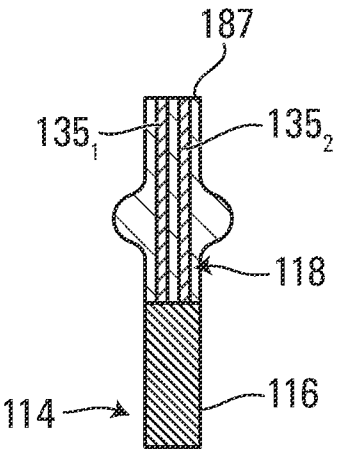
FIGS. 34 and 35 show cross-sections of the blade in examples of a variant in which the anchor comprises a plurality of anchor elements affixed to the base.
Figure 35:
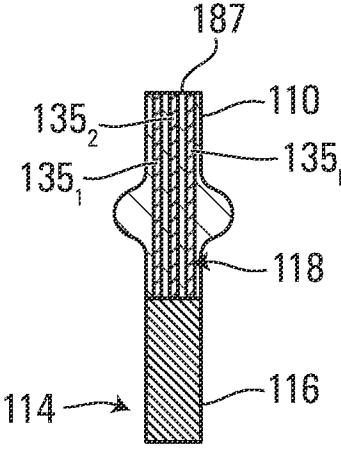
Figure 36:
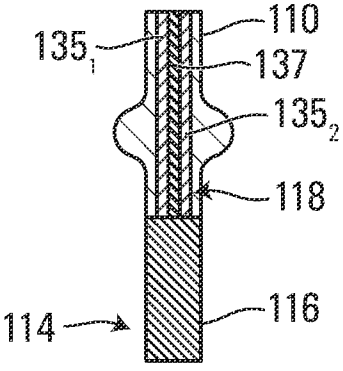
FIG. 36 shows a cross-section of the blade in an example of a variant in which a space between the anchor elements comprises a material different than a material of the upper member.

In other examples of the variant of FIGS. 32 and 33, the anchor 118 may comprise a plurality of anchor elements $\mathbf{135}_1$-$\mathbf{135}_N$, each extending along at least a majority (i.e., a majority or an entirety) of the height $H_P$ of the polymeric upper member 110. For example, as shown in FIG. 34, the plurality of anchor elements $\mathbf{135}_1$-$\mathbf{135}_N$ may include two such anchor elements, or as shown in FIG. 35, the plurality of anchor elements $\mathbf{135}_1$-$\mathbf{135}_N$ may include three or more such anchor elements. In such variants, the anchor elements $\mathbf{135}_1$-$\mathbf{135}_N$ are spaced apart from one another in the widthwise direction of the blade 52 and the material $M_1$ of the polymeric upper member 110 fills the space between the anchor elements $\mathbf{135}_1$-$\mathbf{135}_N$. However, in another variant, as shown in FIG. 36, rather than the material $M_1$ of the polymeric upper member 110 filling the space between the anchor elements $\mathbf{135}_1$-$\mathbf{135}_N$, a material 137 different from the material $M_1$ of the polymeric upper member 110 fills the space between the anchor elements $\mathbf{135}_1$-$\mathbf{135}_N$. For example, the material 137 may have a density that is less than the density of the material $M_1$ of the polymeric upper member 110. More specifically, in this example of implementation, the material 137 comprises foam. This may allow stiffening the blade 52 due to the significant height of the anchor 118 while also limiting its added weight via the smaller density of the material 137.

Figure 37:
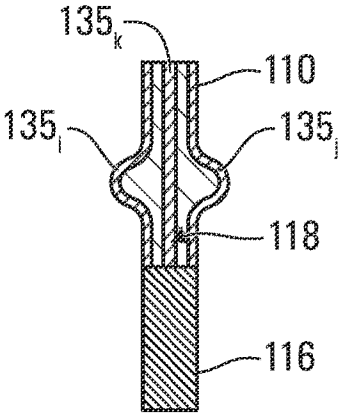
FIG. 37 shows a cross-section of the blade in an example of a variant in which the anchor elements of the anchor define lateral surfaces of the upper member of the blade.

In another example of the variant of FIGS. 32 and 33, as shown in FIG. 37, given ones of the anchor elements $\mathbf{135}_1$-$\mathbf{135}_N$ may constitute exterior layers $\mathbf{135}_i$, $\mathbf{135}_j$ that enclose, in the widthwise direction of the blade 52, the material $M_1$ of the polymeric upper member 110. For example, the exterior layers $\mathbf{135}_i$, $\mathbf{135}_j$ may be formed such as to conform to a shape of the polymeric upper member 110 (e.g., including the projections 155).

Figure 38:
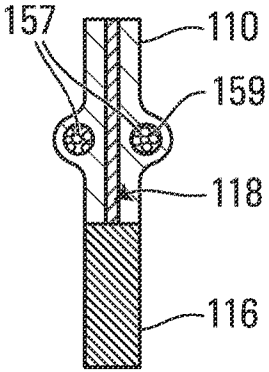
FIG. 38 shows a cross-section of the blade in an example of a variant in which the anchor extends along the majority of the height of the upper member of the blade and the projection on each lateral surface of the upper member comprises an insert.

In another example of the variant of FIGS. 32 and 33, as shown in FIG. 38, the anchor 118 may extend along at least the majority (i.e., the majority or the entirety) of the height $H_P$ of the polymeric upper member 110 while the projection 155 on a given one (or both) of the first and second lateral surfaces 151, 152 comprises the insert 157.

Furthermore, in another example of the variant of FIGS. 32 and 33, as shown in FIG. 38, the anchor 118 may extend along at least the majority (i.e., the majority or the entirety) of the height $H_P$ of the polymeric upper member 110

Figure 39:
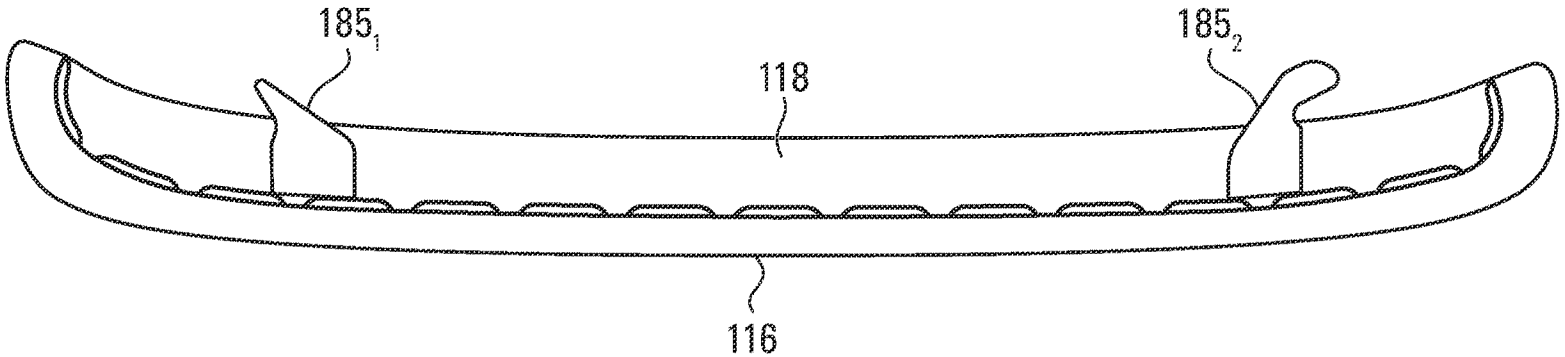
FIG. 39 shows a side elevation view of the ice-contacting lower member of the blade in an example of a variant in which connectors configured to connect the blade to the blade holder are affixed to the anchor.

In yet another variant, the connectors $\mathbf{185}_1$, $\mathbf{185}_2$ which connect the blade 52 to the blade holder 28 may not be part of the polymeric upper member 110. In other words, the connectors $\mathbf{185}_1$, $\mathbf{185}_2$ may not comprise the material $M_1$ of the polymeric upper member 110. For instance, as shown in FIG. 39, the connectors $\mathbf{185}_1$, $\mathbf{185}_2$ may instead be integrally built with the anchor 118 (i.e., the connectors $\mathbf{185}_1$, $\mathbf{185}_2$ and the anchor 118 constitute a unitary structure) and/or fastened to the anchor 118 in any suitable manner (e.g., via welding). In this example, the connectors $\mathbf{185}_1$, $\mathbf{185}_2$ comprise a metallic material such as the material $M_2$ of the anchor 118 or another metallic material (e.g., another stainless steel).

The blade 52 may include any number of different materials in other embodiments, including more than three (e.g., four or five) different materials.

Furthermore, in other embodiments, the ice-contacting lower member 114 may include other types of metallic material (e.g. tungsten carbide or titanium), and/or may include one or more materials that are non-metallic, such as ceramic material (e.g. aluminum titanate, aluminum zirconate, sialon, silicon nitride, silicon carbide, zirconia and partially stabilized zirconia or a combination of two or more of these materials). For example, in some embodiments, the anchor 118 may comprise a non-metallic material. For instance, the anchor 118 may comprise foam (e.g., structural foam).

Figure 20:
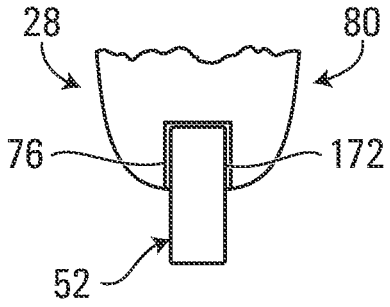
FIGS. 20 to 23 show examples of variants of ways in which the blade holder may retain the blade.
Figure 21:
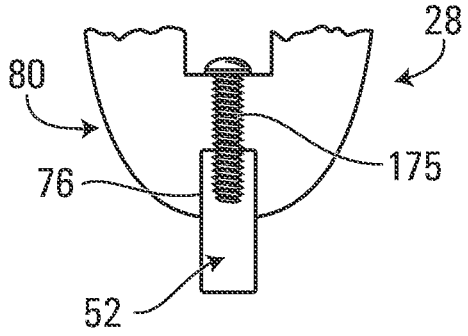
Figure 22:
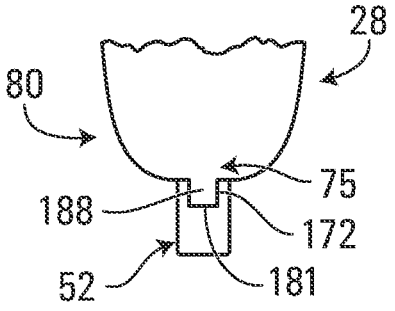
Figure 23:
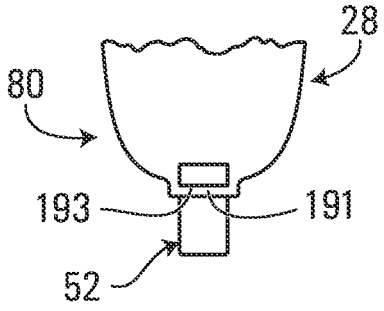
Figure 24:
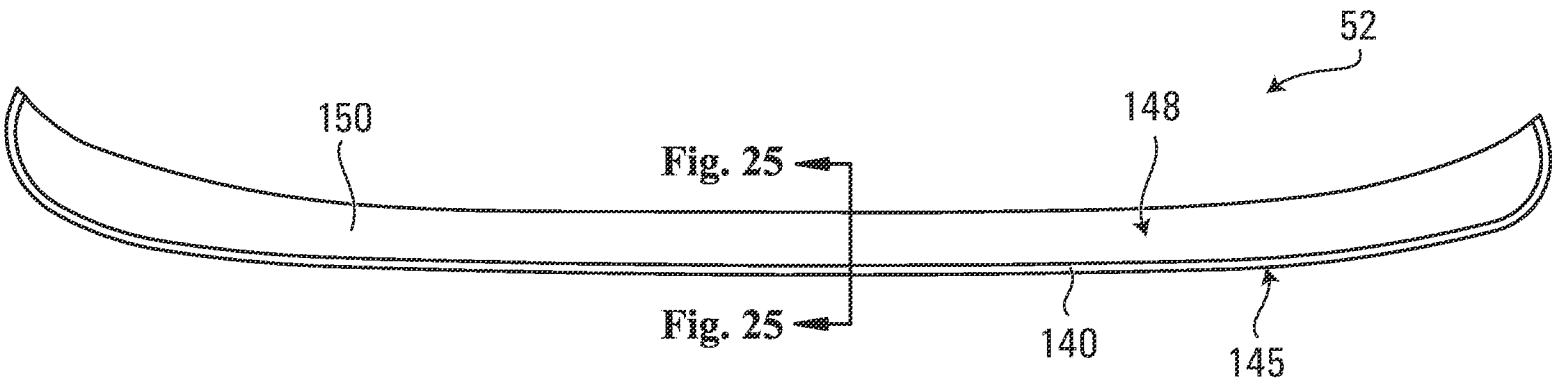
FIGS. 24 and 25 show an example of a variant of the blade.
Figure 25:
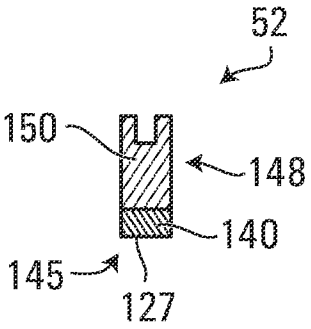

In other embodiments, the blade holder 28 may retain the blade 52 in any other suitable way. For instance, instead of being selectively detachable and removable from and attachable to the blade holder 28, in other embodiments, the blade 52 may be permanently affixed to the blade holder 28 (i.e., not intended to be detached and removed from the blade holder 28). As an example, in some embodiments, as shown in FIGS. 20 and 21, the blade holder 28 may retain the blade 52 using an adhesive 172 and/or one or more fasteners 175. For instance, in some embodiments, as shown in FIG. 20, the recess 76 of the blade holder 28 may receive the upper part of the blade 52 that is retained by the adhesive 172. The adhesive 172 may be an epoxy-based adhesive, a polyurethane-based adhesive, or any suitable adhesive. In some embodiments, instead of or in addition to using an adhesive, as shown in FIG. 21, the recess 76 of the blade holder 28 may receive the upper part of the blade 52 that is retained by the one or more fasteners 175. Each fastener 175 may be a rivet, a screw, a bolt, or any other suitable mechanical fastener. Alternatively or additionally, in some embodiments, as shown in FIG. 22, the blade-retention portion 75 of the blade holder 28 may extend into a recess 181 of the upper part of the blade 52 to retain the blade 52 using the adhesive 172 and/or the one or more fasteners 175. For instance, in some cases, the blade-retention portion 75 of the blade holder 28 may comprise a projection 188 extending into the recess 181 of the blade 52. As another example, in some embodiments, as shown in FIG. 23, the blade 52 and the blade-retaining base 80 of the blade holder 28 may be mechanically interlocked via an interlocking portion 191 of one of the blade-retaining base 80 and the blade 52 that extends into an interlocking void 193 of the other one of the blade-retaining base 80 and the blade 52. For instance, in some cases, the blade 52 can be positioned in a mold used for molding the blade holder 28 such that, during molding, the interlocking portion 191 of the blade-retaining base 80 flows into the interlocking void 193 of the blade 52 (i.e., the blade holder 28 is overmolded onto the blade 52).

In some embodiments, any feature of any embodiment described herein may be used in combination with any feature of any other embodiment described herein.

Certain additional elements that may be needed for operation of certain embodiments have not been described or illustrated as they are assumed to be within the purview of those of ordinary skill in the art. Moreover, certain embodiments may be free of, may lack and/or may function without any element that is not specifically disclosed herein.

Although various embodiments have been illustrated, this was for the purpose of describing, but not limiting, the invention. Various modifications will become apparent to those skilled in the art and are within the scope of this invention, which is defined more particularly by the attached claims.

The invention claimed is:

1. A blade for an ice skate, the ice skate comprising a skate boot for receiving a foot of a user and a blade holder for holding the blade, the blade comprising:

a polymeric upper member; and a metallic ice-contacting lower member secured to the polymeric upper member and comprising:

a metallic base comprising an ice-contacting surface;

a metallic anchor above the metallic base and covered by the polymeric upper member; and at least one opening between the metallic base and the metallic anchor such that the metallic base and the metallic anchor are spaced apart at the at least one opening;

wherein: a height of the metallic anchor is less than a height of the metallic base for at least a majority of a length of the blade; and the polymeric upper member extends through the at least one opening between the metallic base and the metallic anchor.

2. The blade of claim 1, wherein the metallic base comprises a first metallic material and the metallic anchor comprises a second metallic material different from the first metallic material.

3. The blade of claim 2, wherein the first metallic material is a first stainless steel and the second metallic material is a second stainless steel different from the first stainless steel.

4. The blade of claim 2, wherein a strength of the first metallic material is greater than a strength of the second metallic material.

5. The blade of claim 1, wherein the polymeric upper member is a composite upper member comprising a polymeric matrix and fibers disposed in the polymeric matrix.

6. The blade of claim 5, wherein the fibers are continuous fibers.

7. The blade of claim 5, wherein the fibers are chopped fibers.

8. The blade of claim 1, wherein the metallic anchor is welded to the metallic base.

9. The blade of claim 1, wherein the at least one opening between the metallic base and the metallic anchor is a plurality of openings between the metallic base and the metallic anchor.

10. The blade of claim 8, wherein: the at least one opening between the metallic base and the metallic anchor is a plurality of openings between the metallic base and the metallic anchor; and the openings between the metallic base and the metallic anchor are disposed between regions of welding of the metallic base and the metallic anchor.

11. The blade of claim 1, wherein: the polymeric upper member comprises a first lateral surface and a second lateral surface opposite to the first lateral surface of the polymeric upper member; the metallic base comprises a first lateral surface and a second lateral surface opposite to the first lateral surface of the metallic base; the first lateral surface of the polymeric upper member and the first lateral surface of the metallic base are substantially flush with one another; and the second lateral surface of the polymeric upper member and the second lateral surface of the metallic base are substantially flush with one another.

12. The blade of claim 1, wherein: the blade holder comprises a connection mechanism configured to attach the blade to and detach the blade from the blade holder; the connection mechanism of the blade holder comprises an actuator manually operable to detach the blade from the blade holder; the blade comprises a connector configured to connect the blade to the blade holder; and the connector of the blade is configured to engage the connection mechanism of the blade holder.

13. The blade of claim 1, wherein: the blade comprises a plurality of connectors configured to connect the blade to the blade holder; and each connector of the blade comprises a metallic element.

14. A blade for an ice skate, the ice skate comprising a skate boot for receiving a foot of a user and a blade holder for holding the blade, the blade comprising:

a polymeric upper member comprising a first lateral surface and a second lateral surface opposite to the first lateral surface of the polymeric upper member; and a metallic ice-contacting lower member secured to the polymeric upper member and comprising:

a metallic base comprising an ice-contacting surface, a first lateral surface, and a second lateral surface opposite to the first lateral surface of the metallic base; and a metallic anchor affixed to the metallic base and the polymeric upper member;

wherein: the metallic base comprises a first metallic material; the metallic anchor comprises a second metallic material different from the first metallic material; the first lateral surface of the polymeric upper member and the first lateral surface of the metallic base are substantially flush with one another; and the second lateral surface of the polymeric upper member and the second lateral surface of the metallic base are substantially flush with one another.

15. The blade of claim 14, wherein a height of the metallic anchor is less than a height of the metallic base for at least a majority of a length of the blade.

16. The blade of claim 14, wherein the first metallic material is a first stainless steel and the second metallic material is a second stainless steel different from the first stainless steel.

17. The blade of claim 14, wherein a strength of the first metallic material is greater than a strength of the second metallic material.

18. The blade of claim 14, wherein the polymeric upper member is a composite upper member comprising a polymeric matrix and fibers disposed in the polymeric matrix.

19. The blade of claim 18, wherein the fibers are continuous fibers.

20. The blade of claim 18, wherein the fibers are chopped fibers.

21. The blade of claim 14, wherein the metallic anchor is welded to the metallic base.

22. The blade of claim 14, wherein: the metallic ice-contacting lower member comprises at least one opening between the metallic base and the metallic anchor such that the metallic base and the metallic anchor are spaced apart at the at least one opening; and the polymeric upper member extends through the at least one opening between the metallic base and the metallic anchor.

23. The blade of claim 22, wherein the at least one opening between the metallic base and the metallic anchor is a plurality of openings between the metallic base and the metallic anchor.

24. The blade of claim 21, wherein: the metallic ice-contacting lower member comprises a plurality of openings between the metallic base and the metallic anchor such that the metallic base and the metallic anchor are spaced apart at the openings; and the openings between the metallic base and the metallic anchor are disposed between regions of welding of the metallic base and the metallic anchor.

25. The blade of claim 14, wherein: the blade holder comprises a connection mechanism configured to attach the blade to and detach the blade from the blade holder; the connection mechanism of the blade holder comprises an actuator manually operable to detach the blade from the blade holder; the blade comprises a connector configured to connect the blade to the blade holder; and the connector of the blade is configured to engage the connection mechanism of the blade holder.

26. The blade of claim 14, wherein: the blade comprises a plurality of connectors configured to connect the blade to the blade holder; and each connector of the blade comprises a metallic element.

27. A blade for an ice skate, the ice skate comprising a skate boot for receiving a foot of a user and a blade holder for holding the blade, the blade comprising:

a polymeric upper member; and a metallic ice-contacting lower member secured to the polymeric upper member and comprising an ice-contacting surface;

wherein: the blade holder comprises a connection mechanism configured to attach the blade to and detach the blade from the blade holder; the connection mechanism of the blade holder comprises an actuator manually operable to detach the blade from the blade holder; the blade comprises a connector configured to connect the blade to the blade holder; and the connector of the blade is configured to engage the connection mechanism of the blade holder.

28. The blade of claim 27, wherein: the metallic ice-contacting lower member comprises a metallic base comprising an ice-contacting surface and a metallic anchor affixed to the metallic base and the polymeric upper member.

29. The blade of claim 28, wherein a height of the metallic anchor is less than a height of the metallic base for at least a majority of a length of the blade.

30. The blade of claim 28, wherein: the metallic base comprises a first metallic material; and the metallic anchor comprises a second metallic material different from the first metallic material.

31. The blade of claim 28, wherein: the polymeric upper member comprises a first lateral surface and a second lateral surface opposite to the first lateral surface of the polymeric upper member; the metallic base comprises a first lateral surface and a second lateral surface opposite to the first lateral surface of the metallic base; the first lateral surface of the polymeric upper member and the first lateral surface of the metallic base are substantially flush with one another; and the second lateral surface of the polymeric upper member and the second lateral surface of the metallic base are substantially flush with one another.

* * * * *